US007229731B2

(12) United States Patent
Aoki et al.

(10) Patent No.: US 7,229,731 B2
(45) Date of Patent: Jun. 12, 2007

(54) ELECTROPHOTOGRAPHIC PHOTOSENSITIVE MEMBER AND ELECTROPHOTOGRAPHIC APPARATUS USING THE ELECTROPHOTOGRAPHIC PHOTOSENSITIVE MEMBER

(75) Inventors: Makoto Aoki, Yokohama (JP); Satoshi Kojima, Mishima (JP); Hironori Owaki, Wakamatsu (JP); Kazuto Hosoi, Mishima (JP); Jun Ohira, Sunto-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/406,416

(22) Filed: Apr. 19, 2006

(65) Prior Publication Data

US 2006/0188799 A1 Aug. 24, 2006

Related U.S. Application Data

(63) Continuation of application No. PCT/JP2005/020671, filed on Nov. 4, 2005.

(30) Foreign Application Priority Data

Nov. 5, 2004 (JP) ..... 2004-322773

(51) Int. Cl.
*G03G 5/147* (2006.01)

(52) U.S. Cl. ..... 430/66; 430/67; 399/159

(58) Field of Classification Search ..... 430/66, 430/67; 399/159
See application file for complete search history.

(56) References Cited

U.S. PATENT DOCUMENTS

| | | | | |
|---|---|---|---|---|
| 4,677,044 | A * | 6/1987 | Yamazaki et al. | 430/66 |
| 4,923,773 | A | 5/1990 | Yagi et al. | 430/57 |
| 5,059,501 | A | 10/1991 | Yagi et al. | 430/65 |
| 2005/0026057 | A1 | 2/2005 | Hosoi et al. | 430/56 |
| 2006/0194132 | A1 | 8/2006 | Hosoi et al. | 430/66 |

FOREIGN PATENT DOCUMENTS

| | | |
|---|---|---|
| EP | 0616260 | 9/1994 |
| JP | 57-115556 | 7/1982 |
| JP | 01-106071 | 4/1989 |
| JP | 01-289963 | 11/1989 |
| JP | 02-082261 | 3/1990 |
| JP | 02-124578 | 5/1990 |
| JP | 05-073234 | 3/1993 |
| JP | 05-150532 | 6/1993 |

(Continued)

*Primary Examiner*—Christopher Rodee
(74) *Attorney, Agent, or Firm*—Fitzpatrick, Cella, Harper & Scinto

(57) ABSTRACT

To provide a high-image-quality electrophotographic photosensitive member having a high sensitivity for a wavelength close to 380 to 500 nm, remarkable image resolution property in which absorption of the wavelength is hardly recognized, working-environment characteristic and high safety and superior in abrasion resistance and fabrication easiness and reducing optical memories and an electrophotographic apparatus using the high-image-quality electrophotographic photosensitive member. In the case of an electrophotographic photosensitive member having a substrate, photoconductive layer formed on the substrate and surface layer formed on the photoconductive layer and using silicon and nitrogen atoms as base material and containing an amorphous material containing at least oxygen atoms, the surface layer contains nitrogen atoms as an average concentration shown by the following expression (1) and contains oxygen atoms by the maximum value Omax of the number of oxygen atoms in the thickness direction:

$$0.3 \leqq N/(Si+N) \leqq 0.7. \quad (1)$$

18 Claims, 5 Drawing Sheets

FOREIGN PATENT DOCUMENTS

| | | |
|---|---|---|
| JP | 05-188618 | 7/1993 |
| JP | 06-266139 | 9/1994 |
| JP | 07-306539 | 11/1995 |
| JP | 0-8076397 | 3/1996 |
| JP | 08-082943 | 3/1996 |
| JP | 08-171220 | 7/1996 |
| JP | 2000/01975 | 1/2000 |
| JP | 2000/311693 | 10/2002 |

* cited by examiner

ELECTROPHOTOGRAPHIC PHOTOSENSITIVE MEMBER AND ELECTROPHOTOGRAPHIC APPARATUS USING THE ELECTROPHOTOGRAPHIC PHOTOSENSITIVE MEMBER

This application is a continuation of International Application No. PCT/JP2005/020671, filed Nov. 4, 2005, which claims the benefit of Japanese Patent Application No. 2004-322773, filed Nov. 5, 2004.

BACKGROUND OF THE INVENTION

1. Field of the Invention

The present invention relates to an electrophotographic photosensitive member and an electrophotographic apparatus using the electrophotographic photosensitive member, particularly to an electrophotographic photosensitive member most suitable for a printer, facsimile and copy machine using the light having a wavelength of 380 nm or more and 500 nm or less for exposure.

2. Related Background Art

In the case of an electrophotographic apparatus used for a printer, facsimile and copy machine, an image is formed after passing through a step of applying light to a charged photosensitive member by charging means, a step of exposing portions other than the portion corresponding to an image or a portion corresponding to the image and thereby a step of forming an electrostatic latent image corresponding to the image on the photosensitive member, a step of supplying toner to the electrostatic latent image, developing the electrostatic latent image, transferring the toner attached to the electrostatic latent image to a transfer member, a step of fixing the electrostatic latent image and then a step of eliminating static electricity of the surface of the photosensitive member.

For a photoconductive material in a photosensitive member used for the above electrophotographic apparatus, the following characteristics are requested: the material must have a high sensitivity, high SN ratio {photocurrent (Ip)/dark current (Id)}, absorption spectrum suitable for the spectrum characteristic of electromagnetic wave to be applied, quick optical response and desired dark resistance value and the material is harmless for human body when the material is used. Particularly, in the case of an electrophotographic photosensitive member built in an electrophotographic apparatus used in an office as a business machine, nonpolluting property when the photosensitive member is used is an important point and there is amorphous silicon (hereafter simply referred to as a-Si) showing a property superior in this point and it is frequently used as a light receiving member of an electrophotographic photosensitive member.

To prepare this photosensitive member, a conductive substrate is generally heated up to 50 to 350° C. as a photoconductive layer to form a photoconductive layer made of an a-Si film on the substrate in accordance with a film formation method such as vacuum evaporation method, sputtering method, ion plating method, thermal CVD method, optical CVD method, or plasma CVD method. Above all, the plasma CVD method, that is a method for decomposing a source gas through high frequency or microwave glow discharge and forming an a-Si deposited film on the substrate is used as the most preferable method. A surface layer for proving durability for a working environment such as abrasion, temperature or humidity is laminated on the photoconductive layer thus formed and a photosensitive member suitable for practical use is fabricated.

For example, Japanese Patent Application Laid-Open No. S57-115556 discloses a technique for forming a surface barrier layer constituted of a nonphotoconductive non-single-crystal material containing silicon atoms or carbon atoms on a photoconductive layer constituted of a non-single-crystal material using silicon atom as base material (it is allowed to contain polycrystal or microcrystal mainly constituted of an amorphous-state material) in order to improve the working environment characteristics such as electrical and optical photoconductive characteristics of a photoconductive member having a photoconductive layer constituted of an a-Si deposition film such as dark resistance value, light sensitivity and optical response and humidity resistance and moreover time-elapse stability. Moreover, Japanese Patent Application Laid-Open No. H05-150532 discloses a photosensitive member constituted so that the photosensitive member becomes a reverse bias state of p-i-n junction by preparing an amorphous-silicon photosensitive member constituted of a substrate, barrier layer, photocon ductive layer and surface layer from $SiH_4$, $H_2$, $N_2$ and $B_2H_6$ and specifying each flow rate ratio. Furthermore, Japanese Patent Application Laid-Open No. H05-73234 discloses a technique on a photosensitive member having at least a photoconductive layer and a surface layer constituted of an amorphous silicon nitride and capable of reducing image irregularity in a digital copying system using a laser by increasing the nitrogen concentration of the surface layer toward the free surface side.

Furthermore, Japanese Patent Application Laid-Open No. H08-171220 discloses an electrophotographic photosensitive member having a photoconductive layer made of amorphous silicon and a surface layer made of amorphous silicon nitride on a conductive substance, characterized in that the element composition ratio of N/Si on the outermost surface of the photosensitive member ranges 0.8 or more and 1.33 or less and the element composition ratio of O/Si ranges 0 or more and 0.9 or less. Furthermore, Japanese Patent Application Laid-Open No. H08-82943 discloses an electrophotographic photosensitive member characterized in that a surface layer is constituted of amorphous silicon containing nitrogen or amorphous silicon containing nitrogen and III-group element and/or V-group element, the absorbance of the infrared absorption spectrum surface layer stretching vibration of the surface layer has a relation of N—H>Si—H and the hydrogen quantity ranges 1 atm % or more and 7 atm % or less. Furthermore, Japanese Patent Application Laid-Open No. H07-306539 discloses that the surface layer of an amorphous silicon photosensitive member is constituted of amorphous silicon at least containing one of nitrogen, carbon and oxygen and the composition is realized in which the content of the amorphous silicon continuously increases toward the outermost surface.

Electrical, optical, photoconductive and working environment characteristics of an electrophotographic photosensitive member are improved by these techniques and image quality is also improved according to the improvement of them. However, change of an electrostatic latent image to higher fineness is further requested along with change of toner to smaller particle diameter from a recent request for improvement of image quality.

As methods for charging the above a-Si photosensitive member, there are a corona charging method using corona charging, roller charging method for performing direct charging by discharge using a conductive roller and injection charging method for performing charging by sufficiently taking a contact area by magnetic particles and directly providing electric charges for the surface of a photosensitive member. Above all, discharge products are easily attached to the surface of a photosensitive member because the corona charging method and roller charging method use discharge. Moreover, because an a-Si photosensitive member has a surface layer very hard compared with an organic photosensitive member, discharge products easily remain on the surface of the photosensitive member, the resistance of the surface is decreased because the discharge products and moisture are combined due to adsorption of moisture under a high-temperature environment and an image blurring phenomenon may occur because electric charges on the surface are easily moved. Therefore, various devices such as a surface rubbing method and photosensitive member temperature control method may be required.

However, because the injection charging method is a charging method for directly providing electric charges from a portion contacting with the surface of a photosensitive member instead of positively using discharge, the above phenomenon such as the image blurring does not easily occur.

Moreover, because the injection charging method using contact charging is the voltage control type through the corona charging method is the current control type, there is an advantage that it is comparatively easily possible to decrease the irregularity of an electrified potential.

In the case of a conventional a-Si electrophotographic photosensitive member, characteristic is improved for each of electrical optical photoconductive characteristics such as dark resistance value, light sensitivity and optical response and working environment characteristics and time-elapse stability and durability. However, it is an actual condition that there is a room to be further improved for improving comprehensive characteristic.

Particularly, the shift to digitalization and coloring is quickly progressed in recent years and a request for change to high image quality of an electrophotographic apparatus is further raised than ever. The high image quality in this case points out high resolution, high fineness, no-concentration irregularity and no-image defect (no-white point or black point). Moreover, requests for high speed and high durability are quickly increased and it is requested to greatly improve electrical characteristic and photoconductivity, improve uniformity and decrease the number of image defects and greatly improve performances including durability and environment resistance (temperature and humidity change following property).

For example, to improve the resolution of an image, it is effective to decrease the particle size of toner and decrease the spot diameter of a laser beam for forming an image. To decrease the spot diameter of a laser beam, the accuracy of an optical system for applying a laser beam to a photoconductive layer is improved and the numerical aperture of an imaging lens is increased. To increase the numerical aperture of the imaging lens, it is difficult to avoid increase of an apparatus in size and increase of cost in order to increase a lens in size and improve the mechanical accuracy.

Therefore, a technique for shortening the wavelength of a laser beam, decreasing the spot diameter of the laser beam and improving the resolution of an electrostatic latent image has been noticed in recent years. This is because the lower limit of the spot diameter of a laser beam is directly proportional to the wavelength of a laser beam. In the case of a conventional electrophotographic apparatus, a laser beam having an oscillation wavelength of 600 nm or more and 800 nm or less is generally used for image exposure and by further decreasing the wavelength, it is possible to improve the resolution of an image. In recent years, development of a semiconductor laser having a short oscillation wavelength has been quickly progressed, a semiconductor laser having an oscillation wavelength nearby 400 nm used for image exposure of an electrophotographic apparatus is practically used and a photosensitive member capable of addressing to the light in such a short wavelength band is requested.

As a device when using the short wavelength light, Japanese Patent Application Laid-Open No. 2000-258938 discloses that an image forming apparatus includes a ultraviolet-lavender laser-beam oscillator in which a photosensitive layer is a layer containing hydrogenated amorphous silicon and exposure means has a main oscillation wavelength in 380 to 450 nm. Moreover, Japanese Patent Application Laid-Open No. 2002-311693 discloses an electrophotographic apparatus characterized in that an a-Si photosensitive member is used, an electric field applied to the photosensitive member when exposing image forming rays is 150 kV/cm or more and the wavelength of the image forming rays is 500 nm or less.

When using a semiconductor laser having an oscillation wavelength nearby 400 nm for image exposure, it is requested for a photosensitive member that firstly, an exposure wavelength has a sufficient sensitivity and secondly, a surface layer hardly absorbs the oscillation wavelength. Because an amorphous silicon film has the peak of sensitivity nearby 600 to 700 nm, the peak is slightly inferior to a peak sensitivity but the film has a sensitivity nearby 400 to 410 nm by devising a condition. For example, when using a short-wavelength laser of 405 nm, it can be used. However, a sensitivity may be almost halved compared to a peak. In this case, it is preferable that absorption on the surface layer is hardly present.

However, in the case of amorphous silicon carbide (hereafter referred to as a-SiC) material and amorphous carbon (hereafter referred to as a-C) material which have been preferably used for a surface layer, absorption tends to increase nearby 400 to 410 nm. That is, in the case of the a-SiC material, it is possible to improve transmittivity by devising a condition and address the a-SiC material by decreasing the film thickness to a certain extent. However, the surface layer is present in the fate that it is slowly scrapped by friction in the copier. Therefore, to sufficiently make the most use of the characteristic of long service life of the a-Si photosensitive member, a film thickness to a certain degree or more is necessary. Therefore, there is a case in which absorption quantity and service life in a surface area may fall into a relation of tradeoff. Moreover, in the case of an a-C material, it is possible to form a film having a high transmittance depending on a condition. In this case, however, the structure becomes a structure close to polymer and the hardness may lower or the resistance value may become too high. Therefore, in the case of the a-C material, tradeoff between the transmittance and the hardness or resistance may be realized.

When using amorphous silicon nitride (hereafter referred to as a-SiN) for these materials, it is known that an absorption coefficient close to 400 to 410 nm can be lowered by optimizing a condition. However, it is difficult to use such film as the surface layer of a photosensitive member and therefore, it has not been practically used so far.

Japanese Patent Application Laid-Open No. H05-150532 also discloses a forming condition of an a-SiN film preferable as a surface layer. However, also in this case, a wavelength to be used for exposure is only considered up to 550 nm but a sensitivity in exposure of shorter wavelength is not mentioned. Moreover, even in the case of an exposure wavelength of 550 nm, the sensitivity is deteriorated when the film thickness of a surface layer exceeds 0.8 μm.

SUMMARY OF THE INVENTION

An object of the present invention is to provide an electrophotographic photosensitive member in which absorption is hardly recognized for the light having a short wavelength close to 380 to 500 nm, which is provided with a surface layer having abrasion resistance, which has a specially high image resolution property, which is superior in electric photographic characteristic that there is no dark resistance, light sensitivity, optical response property, or optical memory and in which comprehensive characteristics such as working environment characteristic, time-elapse stability and durability are improved and an electrophotographic apparatus having the above photosensitive member.

The present inventors earnestly studied in order to obtain an electrophotographic photosensitive member which can be preferably used for a high-image-quality and high-speed copying process, which has a sensitivity sufficient for practical use of short-wavelength exposure and in which there is no optical memory, charging performance is high, a high-contrast copying process is realized and comprehensive characteristics such as working environment characteristic, time-elapse stability and durability are improved.

The present inventors first prepared a thin film made of an a-SiN:H material preferable as a surface layer in accordance with the conventional method disclosed in Japanese Patent Application Laid-Open No. H05-150532. However, it is found that the film formed by this method has a comparably large absorption coefficient for light of short wavelength for example the light of 400 to 410 nm and in the case of a photosensitive member having such surface layer, the sensitivity may become insufficient for the light having a wavelength close to 400 to 410 nm. Thereafter, as a result of repeated study, it is first found that a surface layer less absorbing short-wavelength light such as 405 nm can be obtained when forming the surface layer in a restricted specific range in which the type of source gas, the flow rate of the source gas, the ratio between the type of the source gas and the flow rate of the source gas and the ratio for input power and gas quantity are properly kept. In this case, when quantitatively showing a film of less absorption and assuming that the quantity of incoming light as $T_0$, quantity of transmitted light as T and film thickness as t (cm), the absorption coefficient α shown by the following expression of the film is 5000 $cm^{-1}$ or less, preferably 3000 $cm^{-1}$ or less.

$$\alpha=-(\ln T/T_0)/t$$

As a result of analyzing the surface layer formed under the specific restricted condition after removing a portion influenced by the environment of the outermost surface by XPS (X-ray photoelectron spectroscopy method), RBS (Rutherford backscattering spectrometry method) and SIMS (secondary ion mass analysis method), it is found that 0.3 or more is preferable and 0.35 or more is more preferable when showing a value allowing absorption in a practical-use film thickness as N/(Si+N) (in the expression, N denotes the number of nitrogen atoms and Si denotes the number of silicon atoms) as a nitrogen including range. Also, it is found that maximum of 0.7 or less is preferable, maximum of 0.6 or less is more preferable regarding yield of film. When forming a surface layer in a condition exceeding the range, it is found that irregularity easily occurs in film thickness, hardness or resistance and the yield rate may be greatly lowered. This is because when the quantity of nitrogen becomes excessively large, it is estimated that combination between films becomes very instable. Moreover, it is found that the range of 0.7 or less is more preferable because the strength of a film can be kept when using the film as a surface layer.

In this case, the portion of the outermost surface influenced by an environment points a portion influenced by an element adsorbed on an outermost surface or oxide film formed on the surface. In the case of a compound containing silicon, silicon atoms present on the surface are easily oxidized in air. To remove this influence, means is used which removes the surface by approx. 10 nm, preferably approx. 20 nm by applying sputtering using Ar atoms in a vacuum state. For example, when performing measurement after evaporating a conductive film for preventing charge-up such as SIMS, it is allowed to sputter a film-thickness corresponding portion obtained by totalizing the thickness of the evaporated film and removed film thickness of approx. 20 nm. Thus, it is possible to substantially remove the influence of adsorbed atoms or a natural oxide film on the outermost surface.

To find the material quality of a surface layer capable of decreasing the diameter of a spot of a laser beam for exposure from a separate cut area, the relation between spot diameter and dot diameter on an image or electrostatic latent image on a photosensitive member having an amorphous-silicon photoconductive layer and various amorphous silicon-nitride surface layers is studied when image-exposing the photosensitive member by using laser beams having wavelengths of 655 nm and 405 nm. As a result of plotting on a graph taking laser-beam spot diameter for the axis of abscissa and dot diameter on an electrostatic latent image or image for the axis of ordinate for each electrophotographic process, as shown in FIG. 7 in the case of the electrophotographic process ((1) in FIG. 7; hereafter referred to as electrophotographic process (1)) when using a laser beam of 655 nm, it is possible to manage to narrow down a spot diameter by the numerical aperture of an optical system but there is a limit to a certain extent. However, in the case of electrophotographic processes ((2)-(5) in FIG. 7; hereafter referred to as electrophotographic processes (2) to (5)) when using a laser beam of 405 nm, because short-wavelength exposure is used, it is possible to further narrow down the spot diameter. Because the short-wavelength exposure is used, it is found that it is possible to further narrow down the spot diameter.

Moreover, the difference between exposure wavelengths also influences light absorption in a photoconductive layer. In the case of a short exposure wavelength, light absorption in a photoconductive layer is restricted to a very shallow area. A light generation carrier is accelerated by an electric field formed by surface electric charges and moves in the film thickness direction. Moreover, surface electric charges and reverse-polarity carriers move to the surface to cancel electric charges and thereby, an electrostatic latent image is formed. However, carriers can also move in the film face direction (direction vertical to the thickness direction) by an electrostatic repulsive force between carriers and this may cause blur of a latent image. Therefore, to form an electrostatic latent image more faithful to an exposure pattern, it is more preferable to decrease the distance for light generation carriers to move to cancel surface electric charges, that is, it is preferable that the light carrier generation area is close to the surface. In the case of the conventional exposure of 600 to 800 nm, carriers are generated because light reaches up to several microns to tens of microns on a photoconductive layer in accordance with the optical characteristic of an a-Si photosensitive member. However, in the case of the exposure of 405 nm, light absorption ends in a very shallow range of the highest portion of the photoconductive layer and a room to spread before light generation carriers reach the upper portion is hardly present. Therefore, a high resolution can be expected. Therefore, it is possible to expect that a difference occurs in resolutions even for the same spot diameters (corresponding to (1) and (2) in FIG. 7A).

However, because of the raw power of a photosensitive member, even if narrowing down a spot diameter to a certain extent or more, a case occurs in which the dot diameter is not decreased any more. For example, even if the minimum spot diameters have almost the same size when using the same 405 nm wavelength light as a laser beam, the dot diameter on an image or electrostatic latent image of a photosensitive member is not decreased, in electrophotographic process (5), compared to the case of the electrophotographic processes (2) to (4). Even if performing image exposure by using laser beams having the same short wavelength, it is shown that there is a case in which an advantage when decreasing a spot diameter cannot be obtained. In the case of the electrophotographic processes (3) and (4), however, when narrowing down a spot diameter up to the minimum value, it is possible to realize a dot diameter smaller than the dot diameter on an image or latent image in the electrophotographic process (2) having the same minimum spot diameter. Thus, even if forming an amorphous silicon-nitride film having the high permeability of a laser beam of short wavelength, it is found that with the forming condition devised, there is a case not directly connected to improvement of resolution. In the case of the electrophotographic process (5), it is considered that a latent image may be blurred due to a defect in a film such as a surface layer and in the case of the electrophotographic processes (3) and (4), it can be estimated that resolution can be further improved by optimizing a surface layer.

Therefore, as a result of performing various reviews of forming conditions by aiming at optimization of the raw power of a surface layer, the present inventors find that it is possible to further improve resolving power while keeping an absorption coefficient small by adding a small number of oxygen atoms.

Though this reason is not known yet, it is considered that by adding a small number of oxygen atoms, moderation of combination occurs in an a-Si film having a large stress and as a result, the number of defects is decreased. As previously described, because an a-SiN film having a high nitrogen concentration has a small absorption coefficient and a very large hardness, it is suitable to use the film as a surface layer. However, there is a case in which the stress in the film may increase when the hardness is large and there is a case in which a very large remaining stress is left in the film. In this case, it is considered that defects are generated after depositing a film because combination is disconnected to moderate the strain due to a stress. Because oxygen has two bond valences, a function for moderating the strain of combination can be estimated by effectively entering the gap between atoms and it is possible to effectively prevent defects from being generated. However, though a hydrogen tailing end has an effect for repairing defects while forming a film, there is not the effect when unreasonable combination or weak combination changes to a defect after a film is deposited. Therefore, moderation of combination occurs due to a small number of oxygens and it is considered that defect reduction can be comprehensively realized by effectively decreasing the number of defects generated after a film is formed in parallel with defect repair by hydrogen. Thus, when a small number of defects are realized, the number of shallow traps present in the film decreases and it is restrained that carriers constrained by traps after charging are re-excited by the end of development and come out. It is considered that the carriers coming out from the shallow traps drift so as to embed a potential difference generated by formation of a latent image. Therefore, it is considered to weaken a latent image or decrease the depth of the latent image. However, when traps are decreased, it is considered that the number of causes for weakening the latent image is decreased and the resolution is improved.

Moreover, when the number of oxygens is small, it is considered that a function same as that of a valence electron controlling impurity occurs and there is a function for correcting mismatching of a band structure. This band mismatching may become a cause for generating accumulation or transverse ventilation of carriers and as a result, it may deteriorate the resolving power.

However, when the content of oxygen atoms increases in a surface layer, it is found that there is a case in which the oxygen atoms may change from an additive role to a structural-material role and the hardness of a film lowers and the remaining potential rises because a resistance value rises and the number of hydrophilic SiO combinations is increased and thereby, a phenomenon that an image is blurred at high temperature and high humidity occurs.

Then, as a result of repeating study, the present inventors obtain a knowledge that the resolution of a photosensitive member is improved when the content of oxygen atoms in a surface layer has a maximum value Omax at an intermediate portion in the thickness direction, that is, when the content has a peak. Moreover, by having and containing the maximum value at the intermediate portion in the thickness direction on the surface layer, it is found that a fluorine atom is an element capable of improving the resolution of a photosensitive member. Moreover, it is found that when oxygen atom and fluorine atom are contained in the intermediate portion in the thickness direction of a surface layer by respectively having a maximum value, this is more preferable.

Thus, by having a structure for providing a specific distribution in the number of oxygen atoms or the number of fluorine atoms contained for unit length in the thickness direction of the surface layer and containing oxygen atoms and/or fluorine atoms in a certain area at a comparative high concentration though the reason in which defect generation is further effectively restrained is not known yet, an area for locally effectively moderating a stress in a film such as a-SiN having a large stress is generated and as a result, it is considered that defect generation is efficiently restrained in the whole film. As previously described, because an oxygen atom has two bond valences, it is possible to estimate a function for moderating the strain of combination in an a-SiN film. Moreover, a fluorine atom has an effect for repairing defects while forming a film by terminating the fault and moreover, it can moderate stress concentration because the atom has a large atom radius and it is possible to prevent a state in which an unreasonable combination or weak combination changes to a defect after depositing the film.

An oxygen atom has the above-described effect for moderating a strain. However, when oxygen atoms are too high concentration, the hardness of a film decreases, the resistance value of the film excessively rises and remaining current increases or the film becomes a hydrophilic film and a tendency appears that a photosensitive member cannot be easily used at a high humidity. However, because there is a high-concentration area at an intermediate portion in the film in the thickness direction, a stress is concentrically moderated at the portion and it is considered that the stress of the whole film can be absorbed by the stress moderation area. Moreover, by restricting the distribution range of oxygen atoms to a peak-like high-concentration area, average concentration becomes a concentration not influencing hardness, resistance value and hydrophilic property and it is possible to realize both a low absorption coefficient and a preferable resolution.

Moreover, because a fluorine atom is a terminal element, the degree of freedom of a network rises by effectively bringing it to a terminal. However, when the number of terminal elements is excessively increased, an undesirable case may occur because the hardness of a film lowers or absorption increases. Also in the case of fluorine atoms, by proving a high-concentration peak-like distribution for them, it is found that resolution can be improved while avoiding the above hardness and absorption problems. This is because by forming a comparatively high-concentration area similarly to the case of oxygen atoms, it is considered that stress moderation can be concentrically performed in the area. Moreover, because the atomic radius of a fluorine atom is slightly larger than that of a hydrogen atom, when fluorine terminates as terminal atoms, it is possible to form a state in which a combination distance increases differently from an area in which the structure of a network hydrogen-terminates and it is considered that the difference between film structures further serves for stress moderation. In this case, there is a case of increasing a combination strain because the atomic radius of a chlorine atom is large. Therefore, it is considered that a fluorine atom improves resolution compared with the case of a chlorine atom.

Particularly, when containing oxygen atoms and fluorine atoms so as to have the maximum value of concentration at an intermediate portion of each surface layer, it is found that the resolution improvement effect can be independently obtained and moreover, the effect of reduction of optical memories can be remarkably obtained. Though this reason is not clear, because a fluorine atom serving as a terminator effectively works in addition to moderation of combination by an oxygen atom and restraint of generation of defects while a film is deposited and prevention of defects generated after the film is deposited are realized at a high dimension, it is considered that improvement of resolution can be realized simultaneously with reduction of optical memories because of further reduction of a localized level density.

In this case, as inclusion distributions on surface layers of oxygen atoms and fluorine atoms, when assuming that maximum values of contents of the number of oxygen atoms and the number of fluorine atoms at intermediate portions of the surface layers in the thickness direction are Omax and Fmax and minimum values of contents of the number of oxygen atoms and the number of fluorine atoms in the thickness direction on the surface layer (for example, when forming a change area between the surface layer and the photoconductive layer, this is not included) are Omin and Fmin, this is preferable because improvement of resolution is more remarkably obtained and this is more preferable when satisfying the relation of $2 \leqq Omax/Omin$ and $2 \leqq Fmax/Fmin$, more preferably $5 \leqq Omax/Omin$ and $5 \leqq Fmax/Fmin$.

Moreover, it is preferable that maximum values of concentrations of oxygen atoms and fluorine atoms on surface layers respectively have a half-value width of 10 to 200 nm on a graph obtained by assigning the thickness of a surface layer to the axis of abscissa and the contents of oxygen atoms and fluorine atoms to the axis of ordinate. By setting the half-value width of a peak to 10 nm or more, defect reduction due to stress moderation is effectively obtained. Moreover, by setting the half-value width of the peak to 200 nm or less, it is considered that resolution or the like can be further improved without impairing the film quality of an area near the peak.

Moreover, it is found that it is more preferable to contain oxygen atoms so as to slowly change the content for unit length over the whole length in the thickness direction or contain fluorine atoms so as to slowly change the number of fluorine atoms contained for unit length in the thickness direction. This reason is not known yet. It is considered that when composition gently changes, stress moderation can be more efficiently obtained. However, when stress moderation does not occur in a certain area, it is considered that more effective stress moderation occurs because stress is slowly dispersed.

Particularly, when containing oxygen atoms so as to slowly change the content for unit length over the entire length of the thickness direction on the surface layer, it is considered that occurrence of defects by moderation of combination can be effectively restrained while realizing the balance of the electrophotographic characteristic by slowly decreasing the concentration of oxygen atoms from the surface so as to have the minimum value Omin of the number of oxygen atoms at the contact portion with a lower layer. Moreover, further reduction of optical memories is realized by the gradient-composition distribution of the oxygen atoms. Though this reason is not clarified, it is considered that a band structure is tilted by the gradient-composition distribution of oxygen and the flow of carriers becomes more smooth.

Furthermore, when considering film irregularity on a surface layer and absorption of light on the surface layer, it is preferable to provide a potential attenuation value for unit energy amount of a laser beam having a wavelength of 405 nm for an electrophotographic photosensitive member of 300 $V \cdot cm^2/\mu J$ or more.

The present inventors reached the present invention in accordance with the above knowledge.

That is, the present invention is an electrophotographic photosensitive member having a substrate, a photoconductive layer formed on the substrate and a surface layer formed on the photoconductive layer using silicon and nitrogen atoms as base material and constituted of non-single-crystal material at least containing oxygen atoms and the surface layer is shown by the following expression (1):

$$0.3 \leqq N/(Si+N) \leqq 0.7 \quad (1).$$

The above expression relates to an electrophotographic photosensitive member containing nitrogen atoms as an average concentration shown (in the above expression, N denotes the number of nitrogen atoms and Si denotes the number of silicon atoms) and oxygen atoms by the maximum value Omax of the number of oxygen atoms in the thickness direction.

An electrophotographic photosensitive member of the present invention has a sensitivity for a wavelength nearby 380 to 500 nm and is provided with a surface layer in which absorption of the wavelength is hardly recognized and which can be easily formed, has a remarkable image resolution property, shows a preferable characteristic even in any environment independently of temperature change or humidity change, is superior in time-elapse stability, abrasion resistance, durability and manufacture easiness and is preferably used for an electrophotographic apparatus showing a high image quality. Moreover, an electrophotographic apparatus of the present invention has an electrophotographic characteristic, particularly high image resolution property, can decrease optical memories, is superior in working environment characteristic, time-elapse stability and durability, improves comprehensive characteristic, has a high safety as an office machine and is superior as a practical-use unit.

DESCRIPTION OF THE PREFERRED EMBODIMENTS

Then, an embodiment of the present invention is described in detail by referring to the accompanying drawings.

FIGS. 1A to 1D are schematic views showing a layer configuration of an electrophotographic photosensitive member of the present invention.

Figure 1A:
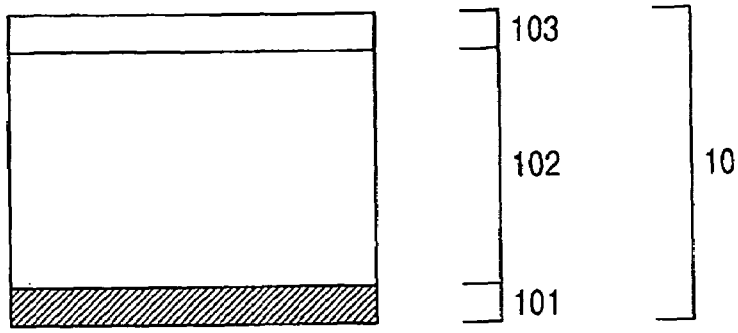
FIG. 1A is a schematic diagram showing an embodiment of an electrophotographic photosensitive member of the present invention.

The electrophotographic photosensitive member 10 shown in FIG. 1A has a configuration in which a photoconductive layer 102 and a surface layer 103 are successively laminated on a substrate 101.

An electrophotographic photosensitive member of the present invention having a photoconductive layer formed on the substrate and a surface layer including a non-single-crystal material formed on the photoconductive layer, using silicon atoms and nitrogen atoms as base members and including at least oxygen atoms is not restricted as long as the surface layer includes nitrogen atoms as an average concentration shown by the following expression (1) and includes oxygen atoms by the maximum value Omax of the number of oxygen atoms in the thickness direction.

$$0.3 \leqq N/(Si+N) \leqq 0.7 \quad (1).$$

In the expression, N denotes the number of nitrogen atoms and Si denotes the number of silicon atoms.

Figure 1B:
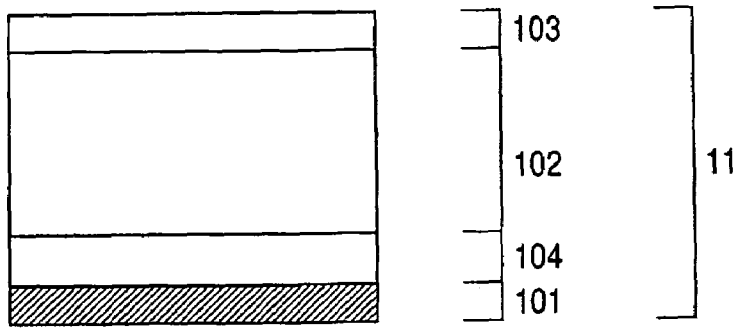
FIG. 1B is a schematic diagram showing another embodiment of an electrophotographic photosensitive member of the present invention.

Moreover, as shown in FIG. 1B, it is preferable to set a lower electric-charge injection preventing layer 104 to an electrophotographic photosensitive member of the present invention on a substrate 101 in order to prevent electric charges from being injected to the photoconductive layer 102 from the conductive substrate side or it is allowed to use an electrophotographic photosensitive member 11 in which the photoconductive layer 102 and the surface layer 103 are successively formed on the lower electric-charge injection preventing layer 104.

Figure 1C:
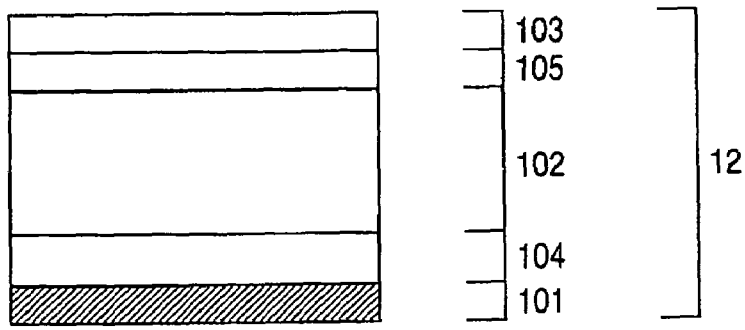
FIG. 1C is a schematic diagram showing still another embodiment of an electrophotographic photosensitive member of the present invention.

Furthermore, as shown in FIG. 1C, it is allowed to change an electrophotographic photosensitive member 12 of the present invention to an electrophotographic photosensitive member 12 in which electric charge injection from the upper portion to the photoconductive layer 102 is reduced, an upper electric-charge injection preventing layer 105 is formed in order to improve charging property and the lower electric-charge injection preventing layer 104, a substrate 101, and on the substrate 101, photoconductive layer 102, upper electric-charge injection preventing layer 105 and surface layer 103 are successively formed. This configuration is particularly preferable to a negatively chargeable electrophotographic photosensitive member.

Figure 1D:
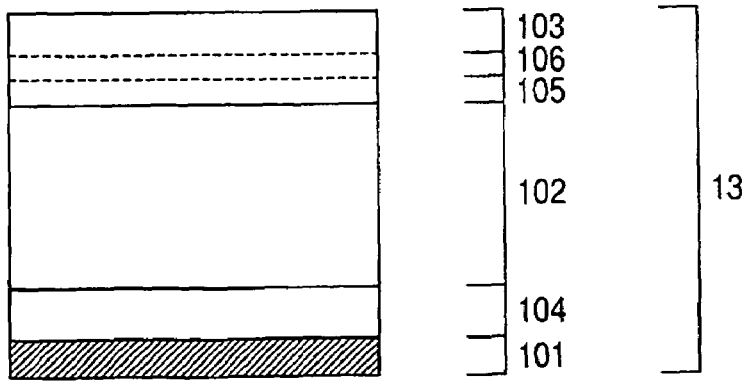
FIG. 1D is a schematic diagram showing still another embodiment of an electrophotographic photosensitive member of the present invention.

Furthermore, as shown in FIG. 1D, it is allowed to use an electrophotographic photosensitive member in which a gradient-composition layer 106 in which change of refractive indexes becomes continuous is formed between the surface layer 103 and the upper electric-charge injection preventing layer 105 as an electrophotographic photosensitive member of the present invention.

Each layer is described below in detail.

(Substrate)

A substrate used for the present invention is not restricted as long as it is possible to form a photoconductive layer on the substrate and it is allowed that a material is conductive or electrical insulating.

As a conductive material of the substrate, metal such as Al, Al alloy or stainless steel can be used. A material obtained by adding Mg or Mn is preferable as the Al alloy.

Moreover, as electric-insulating materials, it is possible to use synthetic-resin films or sheets of polyester, polyethylene, polycarbonate, cellulose acetate, polypropylene, polyvinyl chloride, polystyrene, polyamide and glass and ceramic. In the case of these electrical insulating substrates, it is preferable that at least the surface at the side on which a photoconductive layer is formed undergoes conductive treatment such as depositing a conductive material in accordance with the vacuum deposition method, sputtering method, electroless plating method, or plasma spraying method.

It is preferable that the shape of a substrate is cylindrical or endless-belt like from the viewpoint of the structure of an electrophotographic apparatus to be mounted and it is allowed that the surface of the substrate is a smooth surface or irregular surface. The thickness is properly decided so that a desired photoconductive layer can be formed. However, when flexibility is requested for the photoconductive layer, it is preferable to minimize the thickness as possible in a range in which functions can be sufficiently demonstrated as a substrate. However, the thickness is generally set to 10 μm or more from the viewpoint of fabrication, handling, or mechanical strength.

(Photoconductive Layer)

A photoconductive layer of an electrophotographic photosensitive member of the present invention is not restricted as long as it has a sensitivity on the light having a wavelength of at least 380 to 500 nm. It is allowed that a photoconductive layer of the present invention has a sensitivity on the light having any wavelength but it has a sensitivity on the light having a wavelength of 380 to 500 nm. In this case, having a sensitivity denotes that the potential (light potential) of a portion to which light is applied is lower than the potential (dark potential) of a portion to which light is not applied.

The material of the photoconductive layer having a sensitivity on the light having the wavelength is a non-single-crystal material using a silicon atom as a base material. In this case, it is allowed that the non-single-crystal material is a material such as polycrystal or fine crystal which is not a single-crystal material. However, a material mainly containing an amorphous portion is preferable.

Moreover, it is allowed that the photoconductive layer contains hydrogen atoms and/or halogen atoms. These atoms compensate the dangling bond of a silicon atom and improve layer quality, particularly photoconductivity and electric-charge holding property. The content of hydrogen atoms is not restricted but it is preferable that the content is set to 10 atm % or more and 40 atm % or less for the sum of silicon atoms and hydrogen atoms. Moreover, it is preferable to properly adjust the distribution shape by changing the content in accordance with the wavelength of an exposure system. Particularly, it is known that an optical band gap becomes large and the peak of sensitivity is shifted to the short-wavelength side when increasing the content of hydrogen atoms or halogen atoms to a certain extent. Enlargement of the optical band gap is preferable when using short-wave exposure. In this case, it is preferable to set the content for the sum of silicon atoms and hydrogen atoms to 15 atm % or more.

Moreover, it is preferable to contain atoms for controlling conductivity in the photoconductive layer in the thickness direction of the layer of the photoconductive layer in an ununiform distribution state. This makes it possible to improve charging ability, decrease optical memories and improve sensitivity by adjusting or compensating traveling property of the photoconductive layer and balancing the traveling property at a high dimension. It is allowed that the conductivity control atoms are contained so that the content for unit length in the film thickness direction is continuously or stepwise slowly increased or decreased or contained by having a state in which the content for constant length in the thickness direction is not changed in a state in which the atoms are contained while slowing increasing or decreasing. As atoms for controlling conductivity, the so-called impurity in the semiconductor field can be used and it is possible to use atoms included in the 13th group of the periodic table (also simply referred to as 13th-group atoms) or atoms included in the 15th group of the periodic table (also simply referred to as 15th-group atoms). As the 13th-group atoms, specifically there are boron (B), aluminum (Al), gallium (Ga), indium (In) and thallium (Tl) and particularly B, Al and Ga are preferable.

As the 15th-group atoms, specifically there are phosphorus (P), arsenic (As), antimony (Sb) and bismuth (Bi) and particularly P, As and Sb are preferable. Though contents of the atoms for controlling conductivity are not restricted, it is generally preferable to set each of them to 0.05 atmppm or more and 5 atmppm or less in a photoconductive layer. Moreover, in a range in which light attains, it is also possible that atoms for controlling conductivity are not substantially contained.

Furthermore, it is allowed that a photoconductive layer properly contains helium atoms and hydrogen atoms from the viewpoint of controllability and fabrication of physical property.

In the case of the thickness of a photoconductive layer, it is necessary that a desired electrophotographic characteristic is obtained and efficient fabrication is performed to economic advantage and the thickness ranges between 5 and 50 μm, preferably ranges between 10 and 45 μm and more preferably ranges between 20 and 40 μm. When the layer thickness is 5 μm or more, the photoconductive layer becomes a layer having electrophotographic characteristic for practical use such as charging ability and sensitivity. But when the layer thickness is 50 μm or less, it is possible to restrain the forming cost without requiring time for formation of the photoconductive layer.

To form the above photoconductive layer, it is possible to use the glow discharge method. As the glow discharge method, it is possible to use a method using a high-frequency plasma CVD apparatus to be described later. To form the photoconductive layer by the method, it is basically only necessary to introduce Si-supply source gas capable of supplying silicon atoms (Si), H-supply source gas capable of supplying hydrogen atoms (H) and X-supply source gas capable of supplying halogen atoms (X) according to necessity into a reaction vessel in which pressure can be reduced in a desired gas state, generate glow discharge in the reaction vessel and form a layer constituted of a-Si:H, X on a predetermined substrate previously set to a predetermined position.

As materials which can become Si-supply gases, it is possible to use gas states of $SiH_4$, $Si_2H_6$, $Si_3H_8$ and $Si_4H_{10}$ or silicon hydride (included in silane class) which can be gasified. Moreover, $SiH_4$ and $Si_2H_6$ can be used as preferable substances in tractability and high Si-supply efficiency. It is also allowed that each gas is not the independent type but also gas obtained by mixing a plurality of gases at a predetermined mixture ratio. Furthermore, by considering the controllability of physical property of a film and the convenience of gas supply, it is possible to add one or more types of gases selected from silicon compounds containing $H_2$, He and hydrogen atoms to the above gases by a desired quantity.

As the above halogen-atom-supply source gases, specifically, the following can be used as preferable gases: inter-halogen compounds such as fluorine gas ($F_2$), BrF, ClF, $ClF_3$, $BrF_3$, $BrF_5$, $IF_3$ and $IF_7$ and silicon fluorides such as $SiF_4$ and $Si_2F_6$. To control the quantity of halogen element contained in a photoconductive layer, it is only necessary to control the temperature of a substrate, quantity of a source material to be used for containing a halogen element to be introduced into a reaction vessel, pressure of a discharge space and discharge power.

Moreover specifically, as source materials for introducing atoms for controlling the conductivity of a photoconductive layer, it is possible to use boron hydride such as $B_2H_6$, $B_4H_{10}$, $B_5H_9$, $B_5H_{11}$, $B_6H_{10}$, $B_6H_{12}$ and $B_6H_{14}$ and boron halide such as $BF_3$, $BCl_3$ and $BBr_3$ as 13th-group atom introducing source materials for introducing born atoms. Moreover, it is possible to use $AlCl_3$, $GaCl_3$, $Ga(CH_3)_3$, $InCl_3$ and $TlCl_3$.

Furthermore, as 15th-group-atom introducing source materials, it is possible to use phosphorus hydride such as $PH_3$, $P_2H_4$ for introducing phosphorus atoms and phosphorus halide such as $PH_4I$, $PF_3$, $PF_5$, $PCl_5$, $PBr_3$, $PBr_5$ and $PI_3$. Moreover, it is possible to use $AsH_3$, $AsF_3$, $AsCl_3$, $AsBr_3$, $AsF_5$, $SbH_3$, $SbF_3$, $SbF_5$, $SbCl_3$, $SbCl_5$, $BiH_3$, $BiCl_3$ and $BiBr_3$ as 15th-group-atom introducing start materials. Furthermore, it is allowed to dilute these atom-introducing source materials for controlling conductivity by $H_2$ and/or He according to necessity.

To form a photoconductive layer by using these source gases, it is preferable to properly set a mixture ratio between Si-supply and halogen-addition gases and dilution gas, gas pressure in a reaction vessel, discharge power and substrate temperature. In the case of the flow rate of $H_2$ and/or He used as dilution gas, an optimum range is similarly properly selected in accordance with layer design. It is preferable to control Si-supply gas to a range between 3 and 30 times in the normal case, preferably between 4 and 15 times and optimally between 5 and 10 times. In the case of the gas pressure in a reaction vessel, an optimum range is similarly properly selected in accordance with layer design. For example, the gas pressure ranges between $1\times10^{-2}$ and $1\times10^{3}$ Pa, preferably ranges between $5\times10^{-2}$ and $5\times10^{2}$ Pa and more preferably ranges between $1\times10^{-1}$ and $2\times10^{2}$ Pa. In the case of discharge power, an optimum range is similarly properly selected in accordance with layer design. It is preferable to set the ratio (unit: W·min/ml (normal)) of discharge power to the flow rate of SI-supply gas to a range between 0.5 and 8, preferably a range between 2 and 6. Moreover, in the case of the temperature of a substrate, an optimum range is properly selected in accordance with layer design. It is preferable to set the temperature to a range between 200 and 350° C., preferably a range between 210 and 330° C., more preferably a range between 220 and 300° C. The above ranges are desired numerical ranges of substrate temperature and gas pressure for forming a photoconductive layer. These conditions are normally not independently separately decided. It is preferable to decide an optimum value in accordance with mutual and organic relation in order to form a photoconductive layer having a desired characteristic.

(Surface Layer)

A surface layer used for an electrophotographic photosensitive member of the present invention uses silicon atoms and nitrogen atoms as base materials and is constituted of a non-single-crystal material containing at least oxygen atoms, contains nitrogen atoms as an average concentration shown by the following expression (1):

$$0.3 \leqq N/(Si+N) \leqq 0.7 \quad (1)$$

(In the expression, N denotes the number of nitrogen atoms and Si denotes the number of silicon atoms.). When the surface layer contains oxygen atoms by the maximum value Omax of the number of oxygen atoms in the thickness direction, it is not restricted. Moreover, the surface layer used for an electrophotographic photosensitive member of the present invention uses silicon atoms and nitrogen atoms as base materials and is constituted of a non-single-crystal material containing at least fluorine atoms, contains nitrogen atoms as an average concentration shown by the following expression (4):

$$0.3 \leqq N/(Si+N) \leqq 0.7 \quad (4)$$

(In the expression, N denotes the number of nitrogen atoms and Si denotes the number of silicon atoms.). When the surface layer contains fluorine atoms by the maximum value Omax of the number of fluorine atoms at the intermediate portion in the thickness direction, it is not restricted.

Moreover, when a surface layer used for an electrophotographic photosensitive member of the present invention uses silicon atoms and nitrogen atoms as base materials and is constituted of a non-single-crystal material containing at least oxygen atoms and fluorine atoms and contains nitrogen atoms as an average concentration shown by the following expression (7) and contains oxygen atoms by the maximum value Omax of the number of oxygen atoms at the intermediate portion in the thickness direction and contains fluorine atoms by the maximum value Fmax of the number of fluorine atoms, it is not restricted.

$$0.3 \leqq N/(Si+N) \leqq 0.7 \quad (7)$$

(In the expression, N denotes the number of nitrogen atoms and Si denotes the number of silicon atoms.)

A surface layer of the present invention is set to obtain preferable characteristics on the light transmission property, high resolution, continuous repetitive working resistance, humidity resistance, working environment resistance and preferable electric characteristic mainly for the light having a wavelength of 380 nm or more and 500 nm or less and has a function of an charge holding layer in the case of a positively chargeable electrophotographic photosensitive member. Also in the case of a negatively chargeable electrophotographic photosensitive member, it is allowed that the photosensitive member has a function of charge holding layer. However, it is more preferable to form an upper electric-charge injection preventing layer to be described later and provide a charg holding function for the upper electric-charge inject preventing layer from the viewpoint of the degree of freedom of composition design of the surface layer.

The material of a surface layer of the present invention includes a non-single-crystal material using silicon atoms and nitrogen atoms as base materials and containing oxygen atoms and/or fluorine atoms. It is allowed that the non-single-crystal material using silicon atoms and nitrogen atoms as base materials are constituted of all silicon atoms and nitrogen atoms except oxygen atoms and/or fluorine atoms. However, it is allowed that the non-single-crystal material is a material using silicon atoms and nitrogen atoms as the base material.

The content of nitrogen atoms included in a non-single-crystal material constituting a surface layer is kept in a range shown by the following expression (1) as an average concentration:

$$0.3 \leqq N/(Si+N) \leqq 0.7 \quad (1)$$

(In the expression, N denotes the number of nitrogen atoms and Si denotes the number of silicon atoms.). When the average concentration of nitrogen atoms is kept in the range, it is easy to form a uniform surface layer, the yield is high in fabrication and absorption of image exposure is hardly present. When the content of nitrogen atoms is kept in a range shown by $0.4 \leqq N/(Si+N) \leqq 0.6$, it is possible to further remarkably obtain the above effect. The relational expression (1) becomes the expression (4) or (7) when fluorine atoms instead of oxygen atoms or together with oxygen atoms are included by having the maximum value Fmax of the number of fluorine atoms at the thickness-directional intermediate portion in the layer thickness direction as to be described later.

Figure 2:
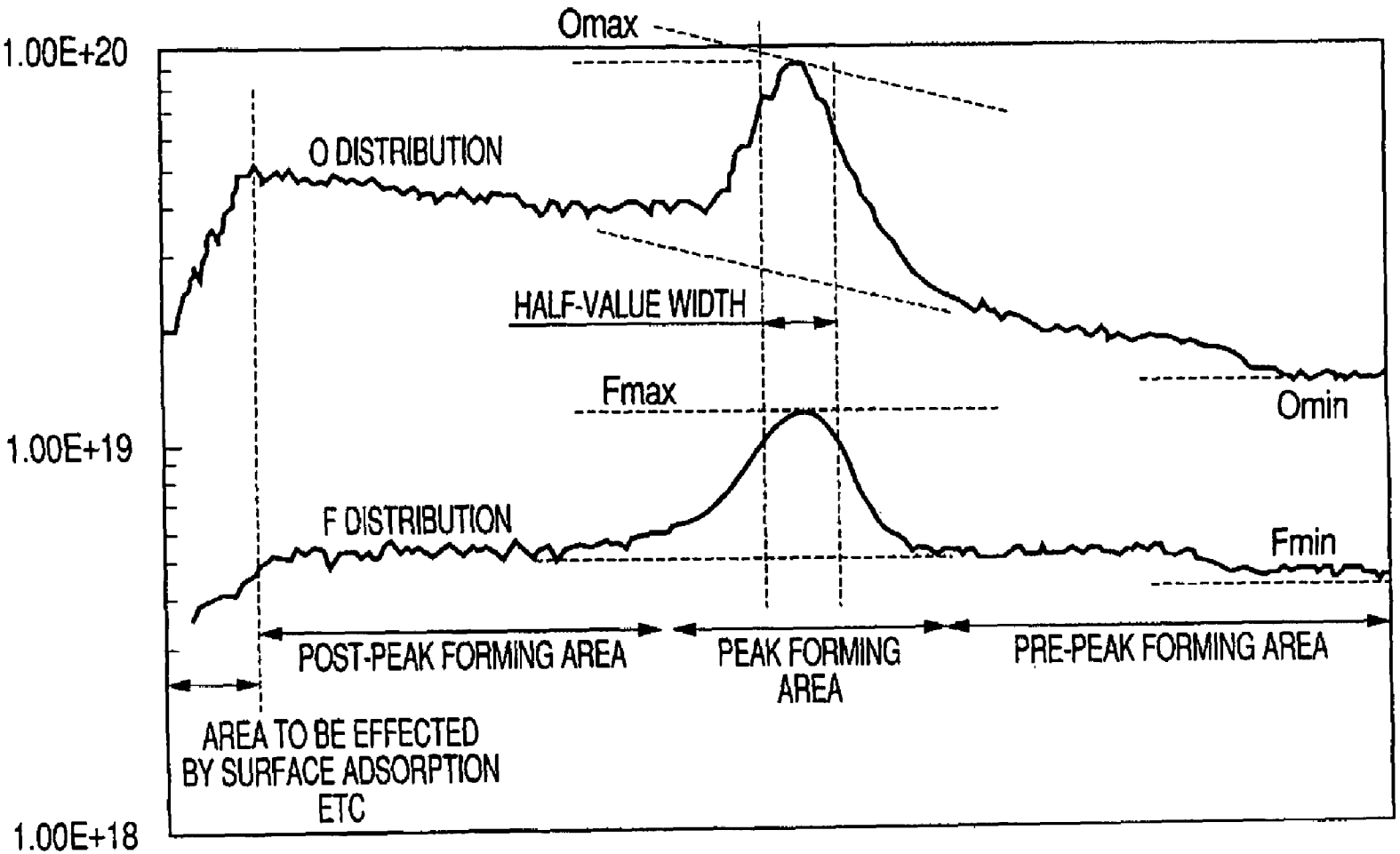
FIG. 2 is an illustration showing a depth profile of inclusion distributions of oxygen atoms and fluorine atoms in the surface layer of an electrophotographic photosensitive member of the present invention.

It is preferable that the maximum value Omax of the number of oxygen atoms at the intermediate portion in the thickness direction on the surface layer has a half-value width of 10 to 200 nm or 1.25 to 25% for the whole thickness in a graph assigning the thickness of the surface layer to the axis of abscissa and the number of contained oxygen atoms to the axis of ordinate. FIG. 2 shows a depth profile by the secondary-ion mass analysis method (SIMS) of a surface layer as the above graph. The depth profile shown in FIG. 2 shows a result of detecting Negative as secondary ions by using IMS-4F made by CAMECA Inc. as an apparatus and $Cs^+$ in which the energy of primary ions is 14.5 keV as a measuring method. In this case, the half-value width denotes the width (width of thickness of surface layer) of the axis of abscissa when the difference between the number of atoms at the peak at the maximum value Omax of the axis of ordinate and the number of atoms on the base line is halved. When the base line tilts, it is possible to obtain the half-value width by correcting two values which is respectively a half of the peak value on the basis of the number of atoms on the base line at the peak value. When the half-value width at the maximum value Omax of the content of oxygen atoms on the surface layer thus obtained is 10 nm or more, it is possible to moderate the stress of the whole surface layer. When the half-value width is 200 nm or less, it is possible to restrain the rise of remaining potential by keeping the hardness and resistance of the whole surface layer and keep characteristics at a high temperature and high humidity by restraining shift to hydrophilic property.

It is preferable that the minimum value of the content of oxygen atoms on the surface layer is present on the contact portion with a lower photoconductive layer and has the relation shown by the following expression (2) as the minimum value Omin:

$$2 \leqq O\max/O\min \quad (2).$$

When the maximum value Omax and the minimum value Omin satisfy this relation, the resolution of a photosensitive member is extremely improved and moreover, it is possible to obtain a remarkable effect by satisfying the relation of $5 \leqq \mathrm{Omax}/\mathrm{Omin}$. The relational expression (2) becomes the expression (8) when fluorine atoms are contained by having the maximum value Fmax of the number of fluorine atoms contained for unit length in the layer thickness direction at the intermediate portion in the thickness direction of the surface layer together with oxygen atoms as to be described later.

It is allowed that the content of oxygen atoms on the surface layer contained for unit length in the surface layer is constant except the maximum value in the thickness direction. However, it is preferable that oxygen atoms are contained so to slowly change the content for unit length over the entire length in the thickness direction. When the content of oxygen atoms changes in the thickness direction of the surface layer, it is considered that stress moderation on the surface layer is dispersed and obtained over the whole. It is preferable that oxygen atoms on the surface layer have the minimum value Omin of the number of oxygen atoms at the contact portion with a lower layer and are contained so as to increase toward an open surface (surface of surface layer when excluding a portion influenced by environment such as oxidation by oxygen in air; the same is applied to the following) through the peak having the maximum value Omax in the thickness direction. For example, as shown in FIG. 2, it is preferable that as the distribution of oxygen atoms, the content of oxygen atoms is high on the open surface of the surface layer, the content decreases toward the lower layer side, the content decreases through the peak having the maximum value Omax of the intermediate portion and the minimum value Omin (right end portion in FIG. 2) is included at the contact portion with a lower layer (photoconductive layer). It is allowed that the distribution of oxygen atoms conforms to continuous change (FIG. 2), exponential change, or stepwise change. However, when having the distribution of oxygen atoms by the exponential change shown in FIG. 2, this is particularly preferable because the electrophotographic characteristic is the best and superior in durability in a photosensitive member. It is possible to restrain stress moderation from locally occurring in the surface layer by the distribution of oxygen atoms in the surface layer and, for example, stress moderation occurs by being gently dispersed so that a load applied to an arch bridge is dispersed, efficient stress moderation of the whole surface layer can be achieved and it is considered that smooth electric-charge movement occurs.

When the content of oxygen atoms on the surface layer included in this distribution is kept in a range shown by the following expression (3) in an average concentration in an amorphous material constituting the surface layer, this is preferable because the content is superior in electrophotographic characteristic and durability:

$$0.0001 \leqq \mathrm{O}/(\mathrm{Si}+\mathrm{N}+\mathrm{O}) \leqq 0.2 \quad (3)$$

(In the expression, N denotes the number of nitrogen atoms, Si denotes the number of silicon atoms and O denotes the number of oxygen atoms.). When the content of oxygen atoms is kept in a range shown by $0.001 \leqq \mathrm{O}/(\mathrm{Si}+\mathrm{N}+\mathrm{O}) \leqq 0.1$, it is possible to remarkably obtain the above effect and when the content is kept in a range shown by $0.005 \leqq \mathrm{O}/(\mathrm{Si}+\mathrm{N}+\mathrm{O}) \leqq 0.08$, it is possible to obtain the above effect more remarkably. The relational expression (3) becomes the expression (6) or (10) when fluorine atoms are contained by having the maximum value Fmax of the number of fluorine atoms contained for unit length in the layer thickness direction at the intermediate portion in the thickness direction of the surface layer instead of oxygen atoms or together with oxygen atoms as to be described later.

On the surface layer used for an electrophotographic photosensitive member of the present invention, fluorine atoms contained instead of or together with oxygen atoms are contained by having the maximum value Fmax of the number of fluorine atoms at the intermediate portion in the thickness direction. It is preferable that the maximum value Fmax of the number of fluorine atoms shown as the number of atoms has a half-value width of 10 to 200 nm or a half-value width of 1.25 to 25% of the whole thickness in a graph shown by assigning the thickness of the surface layer to the axis of abscissa and the content of fluorine atoms to the axis of ordinate. FIG. 2 shows a depth profile by the secondary-ion mass analysis method (SIMS) of a surface layer as the above graph. The depth profile shown in FIG. 2 shows a result of detecting Negative as secondary ions by using IMS-4F made by CAMECA Inc. as an apparatus and Cs+ in which the energy of primary ions is 14.5 keV as a measuring method. When the half-value width is 10 nm or more, it is possible to obtain the stress moderation of the whole surface layer. When the half-value width is 200 nm or less, it possible to realize maintenance of harness of the whole surface layer, restraint of rise of remaining potential by resistivity and characteristic maintenance at high temperature and high humidity by restraint of shift to hydrophilic property.

It is preferable that the minimum value of the content of fluorine atoms on the above surface layer is present at the contact portion (right end portion in FIG. 2) with a lower photoconductive layer and has the relation shown by the following expression (5) as the minimum value Fmin:

$$2 \leqq F\max/F\min \quad (5).$$

When the maximum value Fmax and minimum value Fmin satisfy the above relation, the resolution of a photosensitive member is extremely improved. When they satisfy the relation of 5≦Fmax/Fmin, a remarkable effect can be obtained. The relational expression (5) becomes the expression (9) when fluorine atoms have the maximum value Fmax of the number of fluorine atoms contained in the layer thickness direction at the intermediate portion in the thickness direction together with oxygen atoms in the surface layer.

It is allowed that the content of fluorine atoms contained in the surface layer for unit length in the thickness direction except the maximum value is constant or contained so as to slowly change. When the content of fluorine atoms changes in the thickness direction of the surface layer, it is considered that stress moderation in the surface layer can be dispersed and obtained over the whole. Moreover, as shown in FIG. 2, it is allowed that as the distribution of fluorine atoms, the content is constant except the peak having the maximum value Fmax at the intermediate portion and the minimum value Fmin of the contact portion with a lower layer (right end portion in FIG. 2).

It is possible to contain other atoms in the surface layer. As the atoms, hydrogen atoms are preferable because they compensate dangling bonds of silicon atoms and particularly improve layer quality, the photoconductive characteristic and electric-charge holding characteristic. The hydrogen content in the surface layer is, for example 5 to 70 atm %, preferably 8 to 60 atm % and more preferably 10 to 50 atm % as an average value in the film for the total number of component atoms.

Moreover, it is allowed to contain 13th-group atoms or 15th-group atoms in the periodic table in the surface layer according to necessity. It is allowed that these atoms are contained in the surface layer in a state in which they are uniformly distributed in the surface layer all over or contained in an ununiform distribution state as the number of atoms contained for unit length in the layer thickness direction. The content of the 13th-group atoms or 15th-group atoms in the periodic table in the surface layer ranges between $1\times10^{-3}$ and $1\times10^{3}$ atmppm, preferably between $1\times10^{-2}$ and $5\times10^{2}$ atmppm, more preferably between $1\times10^{-1}$ and $10^{2}$ atmppm.

The thickness of the surface layer is for example, 0.01 to 3 μm, preferably 0.05 to 2 μm and more preferably 0.1 to 1 μm. When the layer thickness is 0.01 μm or more, it is possible to improve the abrasion resistance of a photosensitive member and when the thickness is 3 μm or less, it is possible to obtain an electrophotographic characteristic superior in a photosensitive member without increasing a remaining potential.

It is possible to form the surface layer like this by forming the layer on the above photoconductive layer by the glow discharge method. As this glow discharge method, it is possible to use a method for forming a film on a photoconductive layer formed on a substrate previously set to a predetermined position by basically introducing Si-supply source gas capable of supplying silicon atoms (Si), N-supply source gas capable of supplying nitrogen atoms (N), O-supply source gas capable of supplying oxygen atoms, H-supply source gas capable of supplying hydrogen atoms (H) and/or F-supply source gas capable of supplying halogen atoms (F) into a reaction vessel in which the pressure can be reduced in a desired gas state and generating glow discharge in the reaction vessel.

Substances which can be the silicon (Si)-supply gas used to form the surface layer, it is possible to use gas-state substances such as $SiH_4$, $Si_2H_6$, $Si_3H_8$ and $Si_4H_{10}$ or silicon hydride (in silane category) which can be gasified and moreover $SiH_4$ and $Si_2H_6$ as preferable substances from the viewpoints of tractability and high Si supply efficiency. Moreover, it is allowed to use these Si-supply source gases by diluting them by gas such as $H_2$, He, Ar or Ne according to necessity.

As substances which can be the above nitrogen or oxygen supply gas, it is possible to use gas-state substances such as $N_2$, $NH_3$, NO, $N_2O$, $NO_2$, $O_2$, CO and $CO_2$ or compounds which can be gasified. Above all, as nitrogen supply gas, nitrogen ($N_2$) is preferable because the most preferable characteristic can be obtained. Moreover, as oxygen supply gas, NO is similarly preferable. Furthermore, it is allowed to dilute these nitrogen and oxygen supply source gases by $H_2$, He, Ar or Ne gas according to necessity. Particularly, when adding oxygen by a trace quantity, by previously diluting NO gas by He gas and supplying it, control of accurate flow rate can be made.

Moreover, as materials which can be the above fluorine-atom supply gas and fluorine gas ($F_2$), it is possible to use interhalogen compounds such as BrF, ClF, $ClF_3$, $BrF_3$, $BrF_5$, $IF_3$ and $IF_7$ and silicon fluoride such as $SiF_4$ and $Si_2F_5$.

To form a surface layer by using these source gases, it is necessary to properly set the gas pressure of a reaction vessel, discharge power and temperature of a substrate. In the case of the substrate temperature, an optimum range is properly selected in accordance with layer design. For example, the substrate temperature ranges between 150 and 350° C. (both included), preferably ranges between 180 and 330° C. (both included) and more preferably ranges between 200 and 300° C. (both included). In the case of the pressure of the reaction vessel, an optimum temperature is also properly selected in accordance with layer design. The reaction vessel pressure ranges between $1\times10^{-2}$ and $10^{3}$ Pa (both included), preferably ranges between $5\times10^{-2}$ and $5\times10^{2}$ Pa (both included) and more preferably ranges between $1\times10^{-1}$ and $1\times10^{-2}$ Pa (both included). In the case of the present invention, the above ranges can be used as preferable numerical ranges of the temperature and gas pressure of a conductive substrate for forming a surface layer. Conditions are not normally independently separately decided. It is preferable to decide optimum values of them in accordance with mutual and organic relation for forming a photosensitive member having desired characteristic.

Moreover, to form a surface layer by the glow discharge method using a high frequency in the RF band, a range between 10 and 5,000 W is preferable as discharge power, that is, a range between 2 mW/cm$^2$ and 1.4 W/cm$^2$ in terms of a cathode electrode area is preferable. Above all, to obtain an a-SiN film containing nitrogen atoms at the content in the above-described range and having a preferable transmission coefficient, it is necessary set the flow rate $F_{si}$ (unit: ml/min (normal)) of silicon contained gas, flow rate $F_N$ (unit: ml/min (normal)) of nitrogen contained gas and discharge power $P_W$ (unit: W) to a proper relation. That is, it is found that $P_W \cdot F_N/(F_{si})^2$ which is the product of the power for unit gas quantity, particularly power ($P_W/F_{si}$) for the unit gas quantity of silicon atom contained gas and the gas concentration ratio ($F_N/F_{si}$) between nitrogen contained gas and silicon contained gas ranges between 50 W·min/ml (normal) and 300 W·min/ml (normal) (both included), more preferably ranges between 80 W·min/ml (normal) and 200 W·min/ml (normal) (both included). By using the above values, it is possible to form a film preferable for a surface layer having a high transmission coefficient for the light having a wavelength of 380 to 500 nm. By setting $P_W F_N/(F_{si})^2$ to the above range, the optical band gap of the film becomes approx. 2.8 eV or more and it is also possible to decrease the absorption coefficient to 3000 $cm^{-1}$ or less. When the product of the power and the flow rate ratio is 50 or more, absorption is restrained to transmit a short wavelength. When the product is 300 or less, damage is not introduced from plasma and it is possible to increase the hardness of the film. As this reason, the point is considered that it is necessary for radicals of a source material present in the plasma to have a proper balance. It is considered that the concentration of radicals when source gas is decomposed is decided by source gas concentration ratio and power when using a plurality of source gases. However, because there is a difference between decomposition efficiencies depending on the type of gas, it is considered that the concentration of radicals does not become a proper range unless the power value and gas flow rate ratio are set to proper ranges.

Moreover, because oxygen atoms and fluorine atoms are distributed and contained in the surface layer, it is effective to properly control a deposited film forming conditions such as the concentration of the gas for supplying oxygen atoms and/or fluorine atoms, high-frequency power and substrate temperature. To adjust a content, it is possible to dilute O supply gas such as NO by He gas, accurately control a flow rate through a mass-flow controller and supply the diluted O supply gas into a reaction vessel. Because oxygen atoms can be easily taken into a film only by adding O supply gas by a trace quantity, controllability is improved by properly diluting the O supply gas by dilution gas and using a cylinder in which the O supply gas is diluted up to 100 ppm to 20%.

(Lower Electric-Charge Injection Preventing Layer)

As shown in FIGS. 1B to 1D, it is preferable to set a lower electric-charge injection preventing layer 104 having a function for preventing injection of electric charges to a photoconductive layer from the conductive substrate-101 side onto the upper layer of the conductive substrate 101 to the electrophotographic photosensitive members 11 to 13 of the present invention. The lower electric-charge injection preventing layer 102 has a function for preventing electric charges from being injected to the photoconductive layer side from the substrate-101 side when the lower electric-charge injection preventing layer 102 receives constant-polarity charging processing on its surface.

It is preferable that the lower electric-charge injection preventing layer is made of a single-crystal material using silicon atoms as base material and contains comparatively lot of 13th- or 15th-group elements in the periodic table as impurity compared to the case of a photoconductive layer. In the case of a positively chargeable electrophotographic photosensitive member, it is possible to use 13th-group elements in the periodic table as impurity elements contained in the lower electric-charge injection preventing layer. Moreover, in the case of a negatively chargeable electrophotographic photosensitive member, it is possible to use 15th-group elements in the periodic table as impurity elements contained in the lower electric-charge injection preventing layer. In the case of the present invention, the content of impurity elements contained in a lower electric-charge injection preventing layer is properly decided in accordance with request so that an object of the present invention can be effectively achieved. The content preferably ranges between 10 and 10,000 atmppm (both included) to the total quantity of component atoms in the lower electric-charge injection preventing layer, more preferably ranges between 50 and 7,000 atmppm (both included) and still more preferably ranges between 100 and 5,000 atmppm (both included).

Moreover, it is possible to improve the adhesiveness between the lower electric-charge injection preventing layer and the substrate 101 by containing nitrogen and oxygen in the lower electric-charge injection preventing layer. Furthermore, in the case of a negatively chargeable electrophotographic photosensitive member, it is possible to have superior electric-charge injection preventing ability by optimally containing nitrogen atoms and oxygen atoms without doping the lower electric-charge injection preventing layer with an impurity element. Specifically, in the case of contents of nitrogen atoms and oxygen atoms contained in the whole layer area of the lower electric-charge injection preventing layer, the sum of nitrogen and oxygen preferably ranges between 0.1 and 40 atm % (both included), more preferably ranges between 1.2 and 20 atm % (both included) for the total amount of component atoms in the lower electric-charge injection preventing layer. By setting the sum to 40 atm % or less, further to 20 atm % or less, the electric-charge injection preventing ability is improved.

Moreover, it is preferable to contain hydrogen atoms in a lower electric-charge injection preventing layer of the present invention. In this case, contained hydrogen atoms compensate unconnected hands present in the lower electric-charge injection preventing layer and improve the film quality. The content of hydrogen atoms contained in the lower electric-charge injection preventing layer preferably ranges between 1 and 50 atm % (both included), more preferably ranges between 5 and 40 atm % (both included) and still further preferably ranges between 10 and 30 atm % for the total amount of component atoms in the lower in the lower electric-charge injection preventing layer.

In the case of the present invention, the thickness of a lower electric-charge injection preventing layer must be a thickness from which a desired electrophotographic characteristic can be obtained and ranges between 100 and 5,000 nm (both included), preferably ranges between 300 and 4,000 nm (both included) and more preferably ranges between 500 and 3,000 nm (both included) from viewing of economical effect. By setting the layer thickness to ranges between 100 and 5,000 nm, the injection preventing ability of electric charges from the substrate 101 becomes sufficient, sufficient charging ability can be obtained, improvement of the electrophotographic characteristic can be expected and a trouble such as rise of remaining potential does not occur.

To form the lower electric-charge injection preventing layer, it is necessary to properly set the gas pressure and discharge power in a reaction vessel and temperature of a substrate. An optimum range of a conductive substrate temperature (Ts) is properly selected in accordance with layer design. For example, the temperature ranges between 150 and 350° C. (both included), preferably ranges between 180 and 330° C. (both included) and more preferably ranges between 200 and 300° C. Also in the case of the pressure in the reaction vessel, an optimum range is properly selected in accordance with layer design. For example, the pressure ranges between $1\times10^{-2}$ and $1\times10^{3}$ Pa, preferably ranges between $5\times10^{-2}$ and $5\times10^{2}$ Pa (both included) and more preferably ranges between $1\times10^{-1}$ and $1\times10^{2}$ Pa (both included).

(Upper Electric-Charge Injection Preventing Layer)

As shown in FIGS. 1C and 1D, in the case of the electrophotographic photosensitive members 12 and 13 of the present invention, it is preferable configuration to form the upper electric-charge injection preventing layer 105 between the photoconductive layer 102 and the surface layer 103 in order to effectively achieve the purpose of a negatively chargeable electrophotographic photosensitive member. An upper electric-charge injection preventing layer of the present invention prevents electric charges from being injected from the upper portion (that is, surface layer side) to a photoconductive layer and improves the charging ability.

In the case of the present invention, it is preferable that the material of an upper electric-charge injection preventing layer is a non-crystal material using silicon atoms and nitrogen atoms as base materials similarly to the case of a surface layer. It is allowed that silicon atoms and nitrogen atoms contained in the upper electric-charge injection preventing layer are uniformly distributed in the layer all over or they are contained in a state in which they are ununiformly distributed in the layer thickness direction. However, in any case, on the surface and in the parallel face direction of a substrate, it is preferable that they are contained all over in a uniform distribution from the viewpoint of uniforming the characteristic in the in-face direction.

It is preferable to set the content of nitrogen atoms contained in each layer area of an upper electric-charge injection preventing layer of the present invention in a range between 5 and 35 atm % (both included) for the sum of silicon atoms and nitrogen atoms being component atoms. It is more preferable to set the content in a range between 10 and 30 atm % (both included) and it is still further preferable to set the content in a range between 15 and 30 atm % (both included).

In the case of the present invention, it is preferable that 13th-group elements in the periodic table are contained in the upper electric-charge injection preventing layer of the present invention. As the 13th-group element in the periodic table, there are specifically boron (B), aluminum (Al), gallium (Ga), indium (In) and thallium (Tl), and boron (B) is particularly preferable.

It is allowed that the 13th-group elements in the periodic table contained in the upper electric-charge injection preventing layer are uniformly distributed in the upper electric-charge injection preventing layer all over or contained in a state in which the elements are ununiformly distributed in the layer thickness direction. However, in any case, it is necessary that the elements are contained in a uniform distribution over all over on the surface of and in the parallel in-face direction of a substrate from the viewpoint of uniforming characteristics in the in-face direction.

It is necessary to set the content of 13th-group elements in the periodic table contained in the upper electric-charge injection preventing layer of the present invention in a range between 30 and 5,000 atmppm (both included) for the sum total of component atoms and preferable to set the content in a range between 100 and 3,000 atmppm (both included).

Moreover, in the case of the present invention, it is preferable that hydrogen atoms are contained in the upper electric-charge injection preventing layer. Hydrogen atoms are indispensable in order to compensate unconnected hands of silicon atoms, improve the layer quality and particularly improve the photoconductive characteristic and electric-charge holding characteristic. The content of hydrogen atoms ranges between 30 and 70 atm % (both included) to the total quantity of component atoms in the upper electric-charge injection preventing layer, preferably ranges between 35 and 65 atm % (both included) and more preferably ranges between 40 and 60 atm % (both included).

In the case of the present invention, the thickness of each upper electric-charge injection preventing layer must be a thickness from which a desired electrophotographic characteristic is obtained and ranges between 5 and 1,000 nm (both included), preferably ranges between 10 and 800 nm (both included) and more preferably ranges between 15 and 500 nm (both included) from the viewing of economical effect. When the layer thickness is 5 nm or more, the electric-charge injection preventing ability from the surface side become sufficient, the layer thickness has an electrophotographic characteristic from which a sufficient charging ability is obtained. When the layer thickness is 1,000 nm or less, the electrophotographic characteristic is improved and a sufficient sensitivity can be obtained.

In the case of the upper electric-charge injection preventing layer, it is also preferable to continuously change the composition toward the surface layer from the photoconductive layer side and this is effective for improvement of adhesiveness and prevention of interference.

To form the upper electric-charge injection preventing layer having a characteristic capable of achieving the object of the present invention, it is possible to properly set the mixture ratio between silicon-atom supply gas and nitrogen-atom supply gas, gas pressure in a reaction vessel, discharge power and temperature of a substrate. In the case of the pressure in the reaction vessel, an optimum range is similarly properly selected in accordance with layer design. For example, the pressure ranges between $1\times10^{-2}$ and $1\times10^{3}$ Pa (both included), preferably ranges between $5\times10^{-2}$ and $5\times10^{2}$ Pa (both included) and more preferably ranges between $1\times10^{-1}$ and $1\times10^{2}$ Pa (both included). Moreover, in the case of the temperature of the substrate, an optimum range is properly selected in accordance with layer design. In the normal case, the temperature ranges between 150 and 350° C. (both included), preferably ranges between 180 and 330° C. and more preferably ranges between 200 and 300° C. (both included).

(Gradient-Composition Layer)

The gradient-composition layer 106 formed on the electrophotographic photosensitive member 13 of the present invention shown in FIG. 1D has a composition tilt between the surface layer 103 and the upper electric-charge injection preventing layer 105. By continuously smoothing a change of the refraction index between the surface layer 103 and the upper electric-charge injection preventing layer 105, it is possible to improve the adhesiveness between a surface layer and a photoconductive layer, smooth the movement of optical carriers to the surface and further decrease influences of interference due to reflection of light at the interface between a photoconductive layer and the surface layer. Particularly, when using coherent light for image exposure, it has a function for restraining the interference on the layer interface. However, even when using an LED other than coherent light for image exposure, there are functions for restraining reflection of light on the layer interface and the irregularity of image concentration generated due to a very small cutting irregularity and interference. Moreover, when the upper electric-charge injection preventing layer 105 is not present, it is also allowed to form a gradient-composition layer between the photoconductive layer 102 and the surface layer 103, restrain reflection of the light on a layer interface due to the difference between refractive indexes between the photoconductive layer 102 and the surface layer 103 and restrain occurrence of image irregularity. Furthermore, when the difference between refractive indexes between the upper electric-charge injection preventing layer 105 and the photoconductive layer 102 is large, it is possible to restrain the reflection of image exposure and occurrence of image irregularity by forming a gradient-composition layer between the upper electric-charge injection preventing layer 105 and the photoconductive layer 102 and gently changing refractive indexes.

(Fabrication System of Electrophotographic Photosensitive Member)

Then, a system for fabricating an electrophotographic photosensitive member of the present invention and a film forming method are described below in detail.

Figure 3:
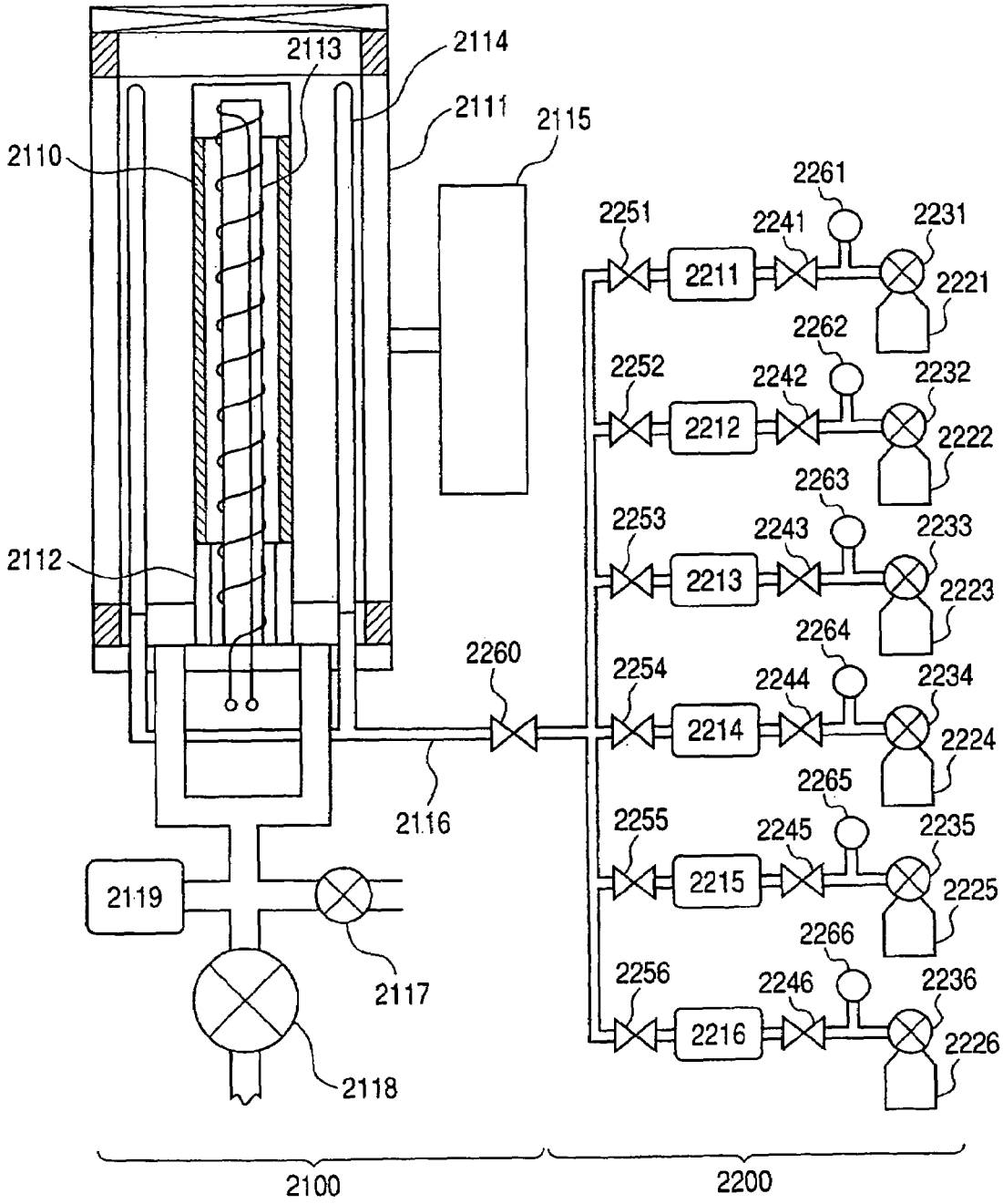
FIG. 3 is a schematic block diagram showing a high-frequency plasma CVD apparatus used to fabricate an electrophotographic photosensitive member of the present invention.

FIG. 3 is a schematic block diagram showing an example of an electrophotographic photosensitive member fabrication system according to the high-frequency plasma CVD method (also referred to as RF-PCVD) using an RF band as a power-supply frequency. A configuration of the fabrication system shown in FIG. 3 is described below.

This system is roughly constituted of a deposition unit (2100), source-gas supply unit (2200) and exhauster (not illustrated) for reducing the pressure in a reaction vessel (2111). A mounting pedestal (2112) for mounting a cylindrical substrate (2110), substrate heating heater (2113) and source-gas introducing pipe (2114) are set in the reaction vessel (2111) in the deposition unit (2100) and moreover, a high-frequency matching box (2115) is connected.

The source-gas supply unit (2200) is constituted of source-gas cylinders (2221 to 2226), valves (2231 to 2236 and 2241 to 2246 and 2251 to 2256) and mass flow controllers (2211 to 2216) and each source-gas cylinder is connected to the gas introducing pipe (2114) in the reaction vessel (2111) through an auxiliary valve (2260).

It is possible to form a deposition film by using the system as described below.

First, the cylindrical substrate (2110) is set to the mounting pedestal (2112) in the reaction vessel (2111) to exhaust the reaction vessel (2111) by a not-illustrated exhauster (for example, vacuum pump). Then, the temperature of the cylindrical substrate (2110) is controlled to a predetermined temperature of 150 to 350° C. by the substrate heating heater (2113).

To make the source gas for forming a deposition film flow into the reaction vessel (2111), it is confirmed that the valves (2231 to 2236) of the gas cylinders are closed, the leak valve (2117) of the reaction vessel is closed and gas inflow valves (2241 to 2246), gas outflow valves (2251 to 2256) and auxiliary valve (2260) are opened and first a main valve (2118) is opened to exhaust the reaction vessel (2111) and source-gas pipe (2116).

Then, when the reading of a vacuum gauge (2119) shows approx. 0.1 Pa or less, the auxiliary valve (2260) and gas outflow valves (2251 to 2256) are closed. Thereafter, gas is introduced from gas cylinders (2221 to 2226) by opening source-gas cylinder valves (2231 to 2236) and gas pressures are adjusted to 0.2 MPa by pressure regulators (2261 to 2266). Then, gas inflow valves (2241 to 2246) are slowly opened to introduce the gases into the mass flow controllers (2211 to 2216).

After the preparation for forming a film is completed as described above, layers are formed in accordance with the following procedure.

When the cylindrical substrate (2110) becomes a predetermined temperature, necessary one of the outflow valves (2251 to 2256) and the auxiliary valve (2260) are slowly opened to introduce predetermined gases from gas cylinders (2221 to 2266) into the reaction vessel (2111) through the source-gas introducing pipe (2114). Then, source gases are adjusted by the mass flow controllers (2211 to 2216) so that they have predetermined flow rates. In this case, the opening of the main valve (2118) is adjusted while viewing the vacuum gauge (2119) so that the pressure in the reaction vessel (2111) becomes a predetermined pressure equal to or lower than $1\times10^2$ Pa. When the inner pressure is stabilized, a RF power supply (not illustrated) having a frequency of 13.56 MHz is set to desired power and RF power is introduced into the reaction vessel (2111) through the high-frequency matching box (2115) to generate glow discharge. Source gases introduced into the reaction vessel by the discharge energy are decomposed and a predetermined deposition film mainly containing silicon is formed on the cylindrical substrate (2110). After the film having a desired thickness is formed, supply of RF power is stopped, outflow valves are closed, inflow of gas into the reaction vessel is stopped and formation of the deposition film is completed.

By repeating the same operation a plurality of times, an electrophotographic photosensitive member having a desired multilayer structure is formed. It is needless to say that all outflow valves are closed other than necessary gases are closed when forming each layer and to avoid gases from remaining in the reaction vessel (2111) and in pipes from the outflow valves (2251 to 2256) to the reaction vessel (2111), the outflow valves (2251 to 2256) are closed, the auxiliary valve (2260) is opened and main vale (2118) is fully opened to perform the operation for once exhausting the system in vacuum according to necessity.

Moreover, to uniform film formation, it is also effective to rotate the mounting pedestal (2112) of the cylindrical substrate (2110) by a drive (not illustrated) at a predetermined speed during forming film.

Furthermore, it is needless to say that the above type of gas and valve operation is changed in accordance with the forming condition of each layer.

A substrate heating method can use any exothermic body as long as it has vacuum specification. More specifically, the following are used: electric resistance exothermic body such as sheath-like-heater wound heater, plate heater, ceramic heater, heat-radiation-lamp exothermic body such as halogen lamp or infrared lamp and exothermic body by heat exchange means using liquid or gas as a temperature medium. The surface material of heating means can use any one of metals such as stainless steel, nickel, aluminum and copper, ceramics or heat-resistant macromolecular resin.

Moreover, a method is used in which a vessel dedicated to heating is set in addition to a reaction vessel and heated to convey a substrate into the reaction vessel in a vacuum state.

(Electrophotographic Apparatus)

An electrophotographic apparatus of the present invention is not restricted as long as it mounts an electrophotographic photosensitive member of the present invention.

Figure 4:
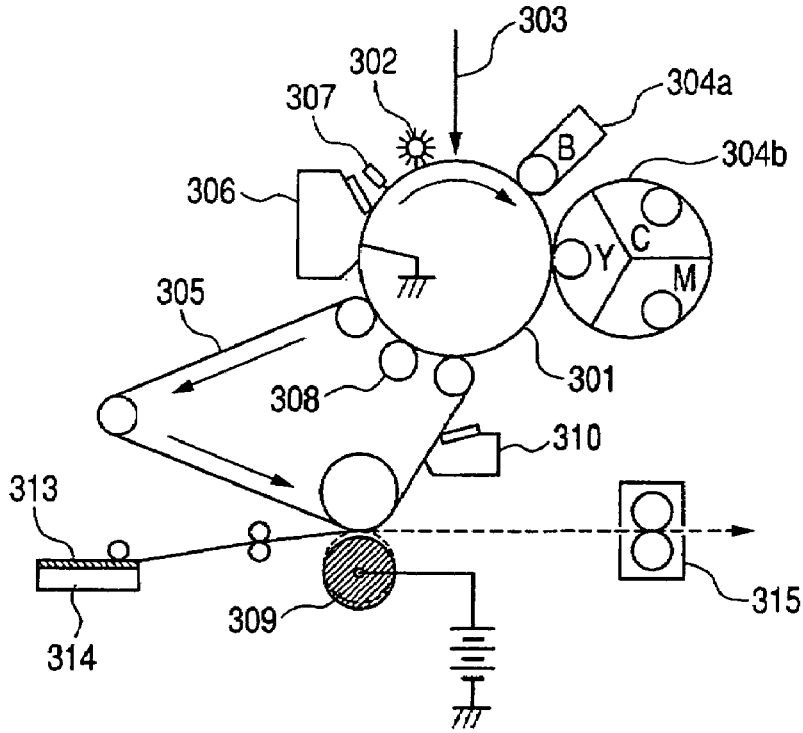
FIG. 4 is a schematic block diagram showing an electrophotographic apparatus of the present invention.

A color electrophotographic apparatus to which an electrophotographic apparatus of the present invention is applied is described below by referring to the schematic block diagram in FIG. 4. The electrophotographic apparatus shown in FIG. 4 is a color electrophotographic apparatus (copy machine or laser-beam printer) using an electrophotographic process for performing transfer by using an intermediate transfer belt 305 constituted of a film-like dielectric belt.

The electrophotographic apparatus is provided with a photosensitive member 301 in which photoconductive layer and surface layer are successively laminated on the above substrate and which is rotated by a rotation mechanism (not illustrated). A primary charging unit 302 provided with a magnetic brush for uniformly electrifying the surface of the photosensitive member drum 301 at predetermined polarity and potential and a not-illustrated image exposure unit for forming an electrostatic latent image by applying image exposure 303 to the surface of the electrified photosensitive member drum 301 are arranged around the photosensitive member drum 301. The image exposure unit is provided with a color separation and imaging exposure optical system of a color original image and a scanning exposure system by a laser scanner for outputting a laser beam modulated by corresponding to a time-series electric digital image signal for image information. Moreover, a first development counter 304*a* for attaching black toner B and a rotation-type second development counter 304*b* including a development counter for attaching yellow toner Y, development counter for attaching magenta toner M and development counter for attaching cyan toner C are arranged around the photosensitive member 301 as development counters for attaching toner on a formed electrostatic latent image. Furthermore, after transferring a toner image to the intermediate transfer belt 305, a photosensitive member cleaner 306 for cleaning the surface of the photosensitive member drum 301 and diselectrifying exposure 307 for diselectrifying the photosensitive member drum 301 are provided.

The intermediate transfer belt 305 is set so as to drive the photosensitive member drum 301 through a contact nip portion and a primary transfer roller 308 for transferring a toner image formed on the photosensitive member drum 301 to the intermediate transfer belt 305 is set inside. A bias power supply (not illustrated) for applying primary transfer bias for transferring a toner image on the photosensitive member drum 301 to the intermediate transfer belt 305 is connected to the primary transfer roller 308. A secondary transfer roller 309 for further transferring the toner image transferred to the intermediate transfer belt 305 to a recording member 313 is set around the intermediate transfer belt 305 so as to contact with the lower portion of the intermediate transfer belt 305. A bias power supply for applying secondary transfer bias for transferring the toner image on the intermediate transfer belt 305 to the recording member 313 is connected to the secondary transfer roller 309. Moreover, an intermediate transfer belt cleaner 310 for cleaning remaining toner left on the surface of the intermediate transfer belt 305 after transferring the toner image on the intermediate transfer belt 305 to the recording member 313 is set.

Moreover, this electrophotographic apparatus is provided with a sheet feed cassette 314 for holding a plurality of recording members 313 on each of which an image is formed and a conveying mechanism for conveying the recording members 313 from the sheet feed cassette 314 through the contact nip between the intermediate transfer belt 305 and the secondary transfer roller 309. A fixing unit 315 for fixing the toner image transferred onto the recording member 313 is set on the conveying route of the recording member 313.

Then, operations of the electrophotographic apparatus are described.

First, as shown by arrows in FIG. 4, the photosensitive member drum 301 is rotated at a predetermined circumferential speed (process speed) clockwise and the intermediate transfer belt 305 is rotated counterclockwise at a circumferential speed equal to that of the photosensitive member drum 301.

The photosensitive member drum 301 is uniformly electrified to predetermined polarity and potential by a primary charging unit 302, receives the image exposure 303 and thereby, an electrostatic latent image corresponding to a first color component image (e.g. magenta component image) of a purposed color image is formed on the surface of the photosensitive member drum 301. Then, a second development counter rotates and a development counter for attaching magenta toner M is set to a predetermined position and its electrostatic latent image is developed by the magenta toner M which is the first color. In this case, the first development counter 304*a* does not act on the photosensitive member drum 301 whose operation is turned off or does not influence the first-color magenta toner image.

Thus, first-color magenta toner images formed on and carried by the photosensitive member drum 301 are sequentially intermediate-transferred to the outer periphery of the intermediate transfer belt 305 by an electric field formed when the primary bias is applied from a bias power supply (not illustrated) to the primary transfer roller 308 during passing through the contact nip portion between the photosensitive member drum 301 and the intermediate transfer belt 305.

The surface of the photosensitive member drum 301 after transferring a first-color magenta toner image to the intermediate transfer belt 305 is cleaned by the photosensitive member 306. Then, a second-color toner image (for example, cyan toner image) is formed on the cleaned surface of the photosensitive member drum 301 similarly to the case of formation of the first-color toner image and the second-color toner image is superimposition-transferred on the surface of the intermediate transfer belt 305 to which the first-color toner image is transferred. Hereinafter similarly, a third-color toner image (for example, yellow toner image) and fourth-color toner image (for example, black toner image) sequentially superimposition-transferred on the intermediate transfer belt 305 and a synthetic color toner image corresponding to a purpose color image is formed.

Then, the recording member 313 is supplied to the contact nip portion between the intermediate transfer belt 305 and the secondary transfer roller 309 from the sheet feed cassette 314 at predetermined timing, the secondary transfer roller 309 contacts with the intermediate transfer belt 305, a secondary transfer bias is applied to the secondary transfer roller 309 from a bias power supply and thereby, the synthetic color toner image superimposition-transferred on the intermediate transfer belt 305 is transferred to the recording member 313 serving as a second image supporter. After the toner image is transferred to the recording member 313, the transfer toner remaining on the intermediate transfer belt 305 is cleaned by the intermediate transfer belt cleaner 310. The recording member 313 to which the toner image is transferred is led to the fixing unit 315 and here, the toner image is heated and fixed on the recording member 313.

In operations of the present electrophotographic apparatus, while sequential transfer of first- to fourth-color toner images from the photosensitive member drum 301 to the intermediate transfer belt 305 is executed, it is allowed to separate the secondary transfer roller 309 and intermediate transfer belt cleaner 310 from the intermediate transfer belt 305.

In the case of an electrophotographic apparatus of the present invention, because absorption is restrained on the surface layer for image exposure of a wavelength of 380 nm or more and 500 nm or less, a high-quality image can be obtained, the apparatus is superior in abrasion resistance environmental property and it is possible to extremely extend the service life. Moreover, in the case of the color electrophotographic apparatus using an intermediate transfer belt, firstly there is less color shift in which forming positions of various color toner images are shifted at the time of superimposition. Furthermore, as shown in FIG. 4, it is possible to transfer a toner image from the intermediate transfer belt 305 without working or controlling the recording member 313 (for example, holding the material 313 by a glipper 2, adsorbing it or providing curvature for it) and use various materials as the recording member 313. For example, it is possible to select sheets having various thicknesses from a thin sheet (40 g/m$^2$) to thick sheet (200 g/m$^2$) and use them as the recording member 313. Furthermore, it is possible to use sheets having various sizes independently of width or length as the recording member 313. Furthermore, it is possible to use an envelope, post card and label as the recording member 313.

EXAMPLES

The present invention is more minutely described in accordance with the following Examples. However, the technical range of the present invention is not restricted to the Examples.

Example 1

Deposition films were sequentially laminated under the conditions shown in Table 1 on a mirror-finished aluminum cylinder (support) having a diameter of 80 mm by using the plasma CVD apparatus shown in FIG. 3 to prepare a photosensitive member constituted of the lower electric-charge injection preventing layer, photoconductive layer, upper electric-charge injection preventing layer and surface layer shown in FIG. 1C. The lower electric-charge injection preventing layer, photoconductive layer and upper electric-charge injection preventing layer were formed in accordance with the conditions show in Table 1 as common conditions. The surface layer was formed by changing flow rates of $SiH_4$ and $N_2$ gases and electric energy every photosensitive member as shown in Table 2 and changing the mixture ratio between $SiH_4$ and $N_2$ and electric energy for $SiH_4$ gas to prepare photosensitive members B-1 to D-3 in which nitrogen concentrations in the surface layer are different from each other. In this case, flow rates of NO gas and $SiF_4$ gas were changed as shown in Tables 1 and 2 so that contents of oxygen atoms and fluorine atoms have peaks in a film. Moreover, a dilution cylinder was used for NO gas and $SiF_4$ gas when flow rates were small. Specifically, 10% He dilution cylinders were used for NO and $SiF_4$ by properly changing the cylinders in accordance with a flow rate. Also when using the dilution cylinder, a flow rate and concentration in Tables 1 and 2 show a flow rate converted into each gas component and concentration corresponding to $SiH_4$.

Comparative Example 1

Except that flow rates of $SiH_4$ and $N_2$ and electric energy were set to the conditions shown in Table 2, photosensitive members A and E having nitrogen atom concentrations in the surface layer different from each other were prepared similarly to the case of the Example 1. In this case, flow rates of NO gas and $SiF_4$ gas were kept constant as shown in Tables 1 and 2 so that contents of oxygen atoms and fluorine atoms are kept constant in a film.

TABLE 1

| Type of gas/Condition | Lower electric-charge injection preventing layer | Photoconductive layer | Upper electric-charge injection preventing layer | Surface layer: Pre-peak area | Surface layer: Peak area | Surface layer: Post-peak area |
|---|---|---|---|---|---|---|
| $SiH_4$[ml/min(normal)] | 170 | 170 | 50 | 20ι80[1)] | 20ι80[1)] | 20ι80[1)] |
| $H_2$[ml/min(normal)] | 600 | 1000 | 100 | 100 | 100 | 100 |
| $CH_4$[ml/min(normal)] | — | — | — | 2 | 2 | 2 |
| $N_2$[ml/min(normal)] | — | — | 200 | 350ι400[1)] | 350ι400[1)] | 350ι400[1)] |
| $B_2H_6$[(ppm(versus $SiH_4$)] | — | 0.5 | 2000 | — | — | — |
| NO[(ppm(versus $SiH_4$)] | 5 | — | — | 1 | 1ι150[1)] | 1 |
| $SiF_4$[(ppm(versus $SiH_4$)] | — | — | — | 1 | 1ι25[1)] | 1 |
| Substrate temperature [° C.] | 270 | 260 | 240 | 220 | 220 | 220 |
| Pressure [Pa] | 80 | 80 | 55 | 55 | 55 | 55 |
| RF power [w] | 200 | 400 | 200 | 200ι300[1)] | 200ι300[1)] | 200ι300[1)] |
| Film thickness [μm] | 2 | 20 | 0.05 | 0.4 | 0.05 | 0.3 |

[1)]Refer to Table 2.

The influence of the outermost surface was removed from the actual nitrogen atom concentration of photosensitive members A to E thus prepared in the surface layer by removing approx. 20 nm of the surface and then, the concentration was analyzed by using ESCA (X-ray photoelectron spectroscopy) analyzer (QUANTUM2000 made by ULVAC-PHI. Inc.) and SIMS (secondary ion mass analysis) analyzer (IMS-4F made by CAMECAS Inc.). The results are shown in Table 2.

Moreover similarly, oxygen and fluorine were measured. As a result, Omin of the photosensitive member B-1 was $1.9\times10^{18}$ atoms/cm$^3$, Fmin was $1.2\times10^{18}$ atoms/cm$^3$, Omax/Omin was 78, Omin of the photosensitive member B-2 was $1.9\times10^{18}$ atoms/cm$^3$, Fmin was $1.2\times10^{18}$ atoms/cm$^3$, Fmax/Fmin was 2.9, Omin of B-3 was $1.9\times10^{18}$ atoms/cm$^3$, Fmin was $1.2\times10^{18}$ atoms/cm$^3$, Omax/Omin was 82, Fmax/Fmin was 3.0, Omin of the photosensitive member C-1 was $1.8\times10^{18}$ atoms/cm$^3$, Fmin was $1.2\times10^{13}$ atoms/cm$^3$, Omax/Omin was 78, Omin of the photosensitive member C-2 was $1.9\times10^{18}$ atoms/cm$^3$, Fmin was $1.3\times10^{18}$ atoms/cm$^3$, Fmax/

Fmin was 2.9, Omin of the photosensitive member D-1 was $2.0\times10^{18}$ atoms/cm$^3$, Fmin was $1.3\times10^{18}$ atoms/cm$^3$, Omax/Omin was 81, Omin of the photosensitive member D-2 was $2.0\times10^{18}$ atoms/cm$^3$, Fmin was $1.2\times10^{18}$ atoms/cm$^3$, Fmax/Fmin was 2.9, Omin of the photosensitive member D-3 was $2.1\times10^{18}$ atoms/cm$^3$, Fmin was $1.3\times10^{18}$ atoms/cm$^3$, Omax/Omin was 83 and Fmax/Fmin was 3.0.

Moreover, the surface-layer film thicknesses of the photosensitive members A to E were measured by the interference film thicknessmeter (MCPD-2000 made by Otsuka Denshi Co., Ltd.) at 10 point in the axis direction and 6 points in the circumferential direction (Total 60 points) and a value obtained by dividing the value of (maximum value)−(minimum value) by an average film thickness was obtained as film thickness irregularity (unit:%). The value of the film thickness irregularity is also shown in Table 2.

Figure 5:
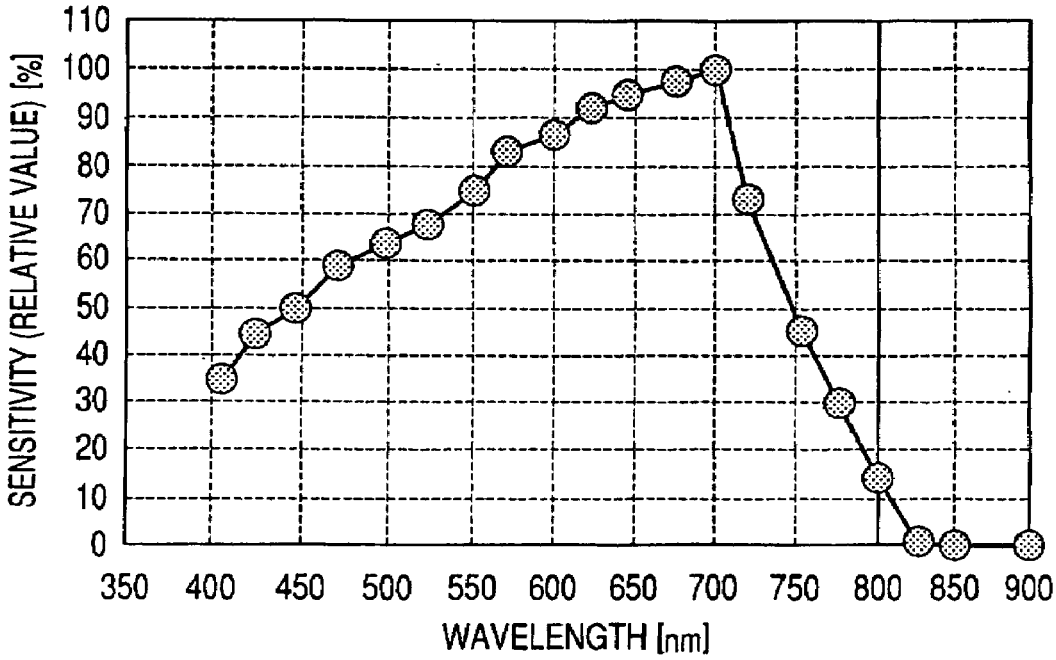
FIG. 5 is a schematic view showing the sensitivity for the wavelength of an electrophotographic photosensitive member of the present invention.
Figure 6:
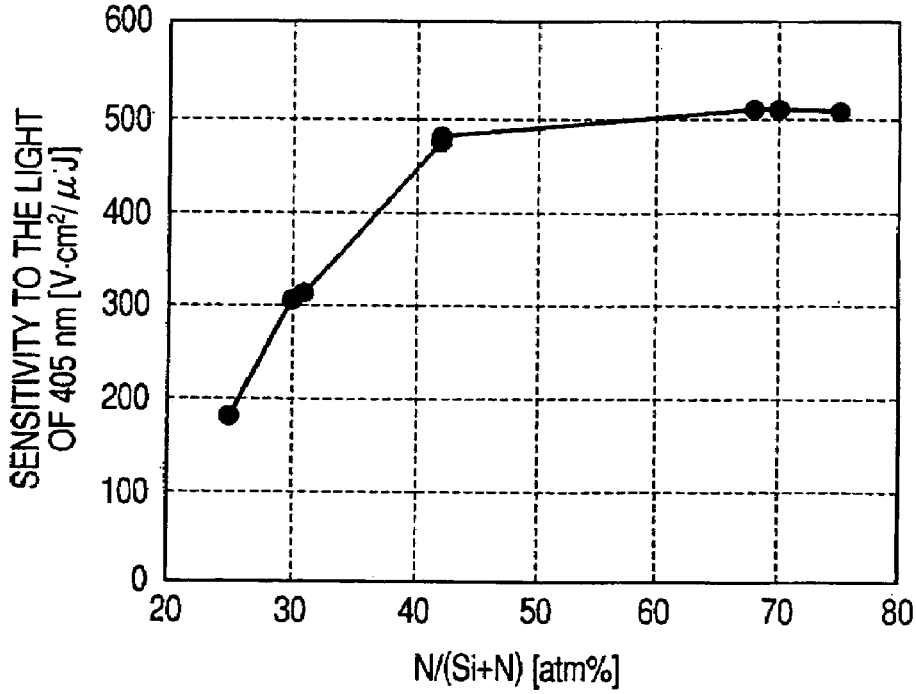
FIG. 6 is a schematic view showing the sensitivity for a wavelength of 405 nm of an electrophotographic photosensitive member of the present invention.

Furthermore, spectral sensitivity characteristics of the photosensitive members A to E were measured. In the case of the spectral sensitivity characteristic, the reciprocal of light quantity necessary for attenuating light from a constant dark-area potential up to a constant light-area potential, that is, a potential attenuation value for unit-energy quantity of light was obtained for each wavelength and a converted value of the potential attenuation value for each wavelength was shown as a relative sensitivity by assuming the maximum potential attenuation value as 100. FIG. 5 shows a spectral sensitivity characteristic obtained for the photosensitive member D-3. Moreover, an absolute sensitivity for the light of 405 nm was obtained for the photosensitive members A to E having contents of nitrogen atoms of the surface layer different from each other and shown in Table 2. Furthermore, FIG. 6 shows a graph obtained by plotting correlations between nitrogen atom concentrations in surface layers of the photosensitive members A to E and the absolute sensitivity to the light of 405 nm.

As shown in Table 2, a clear correlation is observed between a nitrogen atom concentration and the sensitivity to the light of 405 nm. As the nitrogen atom concentration rises, the sensitivity to the light of 405 nm is improved. That is, it is found that a tend is shown in which the adaptability for a blue-light-emitting semiconductor laser beam is improved. For the photosensitive member A having a low nitrogen atom concentration of a surface layer, the sensitivity for the light having a wavelength of 405 nm is insufficient and it is difficult to obtain a potential contrast enough to use it for an electrophotographic apparatus. The value of sensitivity necessary for an electrophotographic process depends on the performance of a laser device or optical system to be used and therefore, it is difficult to refer to the absolute value of the value of sensitivity. According to the study by the present inventors, as a result of measuring a spectral sensitivity when a surface layer is not used, the spectral sensitivity shown in FIG. 6 ranges between 500 and 550 V·cm$^2$/μJ. When considering absorption on a surface layer, it is preferable to have a sensitivity of 300 V·cm$^2$/μJ or more and more preferable to have a sensitivity of 400 V·cm$^2$/μJ or more. Therefore, to obtain the sensitivity for a short-wavelength laser beam nearby 405 nm like the case of the blue-light emitting semiconductor laser, it is found that it is preferable to set a nitrogen atom concentration in a surface layer to 30 atm % or more, more preferable to set the concentration to 35 atm % or more.

However, the photosensitive member E has a large film thickness irregularity of 30% or more and it is found that a nitrogen concentration in a surface layer is 70 atm % or less, more preferably 65 atm % or less.

TABLE 2

| | Photosensitive member | $SiH_4$ ml/min (normal) | $N_2$ ml/min (normal) | NO ml/min (normal) | $SiF_4$ ml/min (normal) | Power W | N/(Si + N) atm % | Sensitivity to light of 405 nm V-cm$^2$/μJ | Film thickness irregularity of surface layer % |
|---|---|---|---|---|---|---|---|---|---|
| Comparative example 1-1 | A | 80 | 350 | 1 | 1 | 300 | 25 | 180 | 11 |
| Example 1 | B-1 | 50 | 400 | 150 | 1 | 250 | 30 | 305 | 8 |
| | B-2 | 50 | 400 | 1 | 25 | 250 | 31 | 310 | 8 |
| | B-3 | 50 | 400 | 150 | 25 | 250 | 30 | 305 | 8 |
| | C-1 | 32 | 350 | 150 | 1 | 200 | 42 | 474 | 7 |
| | C-2 | 32 | 350 | 1 | 25 | 200 | 42 | 480 | 7 |
| | D-1 | 25 | 380 | 150 | 1 | 200 | 70 | 509 | 16 |
| | D-2 | 25 | 380 | 1 | 25 | 200 | 68 | 510 | 16 |
| | D-3 | 25 | 380 | 150 | 25 | 200 | 70 | 510 | 16 |
| Comparative example 1-2 | E | 20 | 380 | 1 | 1 | 200 | 75 | 509 | 35 |

Example 2

Deposition films were sequentially laminated under the conditions shown in Table 3 on a mirror-finished aluminum cylinder (support) having a diameter of 80 mm in accordance with the conditions shown in Table 3 by using the plasma CVD apparatus shown in FIG. 3 to prepare a positively chargeable photosensitive member G constituted of the lower electric-charge injection preventing layer, photoconductive layer and surface layer shown in FIG. 1B. By using gases obtained by diluting NO and $SiF_4$ by helium, 1 ppm was linearly increased up to the values (200 ppm, 20 ppm) in Table 3 for predetermined time and then, the values were linearly decreased up to 1 ppm, at the same speed.

The surface layer of the obtained photosensitive member G was composition-analyzed by SIMS (IMS-4F made by CAMECA Inc.). It was found that the number of atoms contained for unit length in the thickness directions of oxygen atoms and fluorine atoms in the surface layer had a peak. Omax/Omin and Fmax/Fmin in the peak were 92 and 2.5 and the half-value width of the peak formed portion was approx. 70 nm. The value of Omin was $2.1\times10^{18}$ atoms/cm$^3$ and the value of Fmin was $1.8\times10^{18}$ atoms/cm$^3$. Moreover, the quantity of nitrogen was 43 atm % in the expression of N/(Si+N).

Comparative Example 2

A lower electric-charge injection preventing layer and photoconductive layer were formed under the same conditions as the case of the Example 1 except that the supply gas quantity was constant and it did not have a peak by using the type of gas shown in Table 3 as a surface layer to prepare a positively chargeable photosensitive member H (comparative example 2-1) obtained by depositing a surface layer constituted of a-SiC:H and a positively chargeable photosensitive member I (comparative example 2-2) obtained by depositing a surface layer constituted of a-SiN:H.

TABLE 3

| Type of gas/Condition | Example 2 (Photosensitive member G) Lower electric-charge injection preventing layer | Photoconductive layer | Surface layer Pre-peak area | Peak area | Post-peak area | Comparative example 2-1 (Photosensitive member H) Surface layer | Comparative example 2-2 (Photosensitive member I) Surface layer |
|---|---|---|---|---|---|---|---|
| $SiH_4$[ml/min(normal)] | 170 | 170 | 30 | 30 | 30 | 15 | 30 |
| $H_2$[ml/min(normal)] | 600 | 1000 | 100 | 100 | 100 | 100 | 100 |
| $CH_4$[ml/min(normal)] | — | — | — | — | — | 600 | — |
| $N_2$[ml/min(normal)] | — | — | 300 | 300 | 300 | — | 300 |
| $B_2H_6$[(ppm(versus $SiH_4$)] | 1500 | 0.5 | — | — | — | — | — |
| NO[% or ppm(versus $SiH_4$)] | 5% | — | 1 ppm | 200 ppm | 1 ppm | — | — |
| $SiF_4$[(ppm(versus $SiH_4$)] | — | — | 1 ppm | 20 ppm | 1 ppm | — | — |
| Substrate temperature [° C.] | 270 | 260 | 220 | 220 | 220 | 270 | 220 |
| Pressure [Pa] | 80 | 80 | 60 | 60 | 60 | 60 | 60 |
| RF power [w] | 200 | 400 | 180 | 180 | 180 | 250 | 180 |
| Film thickness [μm] | 2 | 20 | 0.3 | 0.07 | 0.4 | 0.8 | 0.8 |

The obtained photosensitive member G and the photosensitive members H and I of comparative examples were evaluated by mounting them on an electrophotographic apparatus. The following evaluation was performed by using the electrophotographic apparatus whose schematic configuration is shown in FIG. 4 and setting the photosensitive member G and photosensitive members H and I of the comparative example to the machine (obtained by using the electrophotographic apparatus iR-6000 made by CANON INC., remodeling an electrifying unit to a positively chargeable magnetic brush system for experiments, remodeling an image exposure system to an image exposure system (IAE system) for exposing an image portion and exchangeably remodeling the light source for image exposure to a red-light-emitting semiconductor laser having an oscillation wavelength of 660 nm or blue-light-emitting semiconductor layer having an oscillation wavelength of 405 nm and remodeling an optical system for image exposure so that the drum face irradiation spot diameter can be adjusted)(hereafter referred to as iR-6000 remodeled machine).

First, the blue (405 nm) semiconductor laser was used as an exposure light source by using the photosensitive member G. In the case of this combination, an 1-dot 1-space image was printed out and resolution was evaluated in accordance with the reproducibility of dots in the image. An output image was enlarged and observed by an optical microscope to obtain a dot size and compare the value with the spot size of an image forming optical laser. The absolute value of the difference between the dot size measured on the image and the laser spot diameter was assumed as a dot strain and the resolution of a photosensitive member was evaluated according to the value of dot strain/laser spot diameter. Because the exposure wavelength was short, it was possible to easily decrease the laser spot diameter up to 30 μm without using a special optical system. When the spot diameter was set to 30 μm and 1,200 dpi, the value of dot strain/laser spot diameter was obtained. As this value decreases, it is shown that dot reproducibility is more preferable. The obtained results are shown in Table 4.

However, comparison was performed by using the total of four types such as a case of using a red (660 nm) semiconductor laser for the photosensitive member H, a case of using image formation by 600 dpi by a spot diameter as 60 μm and using the beam having a spot diameter of 60 μm of a red (660 nm) semiconductor laser for the photosensitive member I, case of using a beam having a spot diameter of 60 μm by using blue (405 nm) semiconductor laser and case of using a beam whose spot diameter as 60 μm was decreased to 30 μm by using blue (405 nm) semiconductor laser and forming an image at 1,200 dpi.

Each photosensitive member was evaluated in accordance with the determination shown below on the basis (REF) of a result when setting a spot diameter to 60 μm by using a red (660 nm) semiconductor laser for the photosensitive member H.

AAA: Improved by 20% or more compared to REF and very preferable level

AA: Improved by 10% or more compared to REF and considerably preferable level

A: Improved by 5% or more compared to REF and preferable level

B: Improved by less than 5% compared to REF and level almost equal to REF

TABLE 4

| | Photosensitive member | Surface layer Material | Surface layer Composition distribution | Light wavelength nm | Spot diameter μm | Dot pitch dpi | Resolution |
|---|---|---|---|---|---|---|---|
| Example 2 | G | SiN | Present | 405 | 30 | 1200 | AAA |
| Comparative example 2-2 | I | SiN | Absent | 405 | 30 | 1200 | A |
| Comparative example 2-2 | I | SiN | Absent | 405 | 60 | 600 | B |
| Comparative example 2-2 | I | SiN | Absent | 660 | 60 | 600 | B |
| Comparative example 2-1 | H | SiC | Absent | 660 | 60 | 600 | B |

As shown in Table 4, when using the same wavelength (660 nm) and the same spot diameter (60 μm), resolution does not depend on the material of a surface layer. Then, to use a blue semiconductor laser, it is necessary to use an SiN material having a composition capable of sufficiently transmitting blue (405 nm) as the material of a surface layer. Moreover, though the evaluation rank is the same, by using blue (405 nm) exposure, dot reproducibility is slightly improved compared to the case of using red (660 nm) exposure even for the same sot diameter (60 μm). This may be because the drift distance of a carrier in a photoconductive layer differs. Moreover, when using a blue (405 nm) semiconductor laser, even if using the same optical system, it is possible to easily decrease a spot diameter up to 30 μm and therefore, dot reproducibility is greatly improved. However, by halving the spot diameter, the size of a dot is not halved it is found that there is a limit decided by the characteristic of a surface layer. Therefore, when using a surface layer formed so as to have an oxygen peak in the surface layer, it is possible to further improve dot reproducibility and it is found that the effect of decreasing the original spot diameter is sufficiently demonstrated.

Example 3

By using an electrophotographic photosensitive member fabrication apparatus according to the RF-PCVD method shown in FIG. 3, deposition films were sequentially laminated on a cylindrical aluminum substrate (conductive substrate) having a diameter of 80 mm and mirror finished in accordance with the fabrication conditions shown in Table 5 to form positively chargeable electrophotographic photosensitive members 3-a to 3-m respectively constituted of the lower electric-charge injection preventing layer, photoconductive layer and surface layer shown in FIG. 1B. While the deposition film of the surface layer was formed, flow rates of NO gas and $SiF_4$ gas were changed to Xppm and Yppm (for $SiH_4$ flow rate). Specifically, by using gases diluted by NO and $SiF_4$ by helium and linearly increasing the gases from 1 ppm up to Xppm and Yppm for a predetermined time in a peak forming area and then, linearly decreasing them up to 1 ppm at the same speed, the positively chargeable electrophotographic photosensitive members 3-a to 3-m were formed so as to respectively have peaks of oxygen atoms and fluorine atoms.

The depth profiles of the content of oxygen atoms and fluorine atoms were measured by SIMS (IMS-4F made by CAMECA Inc.) for the electrophotographic photosensitive members thus prepared. As a result, it was possible to confirm that the contents or content of oxygen atoms and/or fluorine atoms had a peak in the thickness direction of a surface layer. The half-value width of a peak forming portion was approx. 70 nm. Moreover, nitrogen quantity was 57 atm % in the expression of N/(Si+N).

Moreover, Table 6 shows Omax/Omin and Fmax/Fmin when setting the contents of oxygen atoms and fluorine atoms in the surface layer to the maximum values of Omax, Fmax and minimum values of Omin and Fmin from a result of measuring a depth profile of each electrophotographic photosensitive member by SIMS. Though there is a slight fluctuation depending on a sample, the value of Omin is $2.0\times10^{18}$ atoms/$cm^3$ and the value of Fmin is $1.0\times10^{18}$ atoms/$cm^3$.

Comparative Example 3

A positively chargeable electrophotographic photosensitive member J (comparative example 3) constituted of a lower electric-charge injection preventing layer, photoconductive layer and surface layer similarly to the case of the Example 3 except that a surface layer was formed by keeping the type of gas shown in Table 5 as a constant quantity. As a result of measuring the positively chargeable electrophotographic photosensitive member J by SIMS similar to the case of the Example 2, it was confirmed that the content of oxygen atoms or fluorine atoms does not have a peak in the thickness direction in the surface layer.

TABLE 5

| Type of gas/Condition | Example 3 Lower electric-charge injection preventing layer | Example 3 Photoconductive layer | Example 3 Surface layer Pre-peak area | Example 3 Surface layer Peak area | Example 3 Surface layer Post-peak area | Comparative example 3 (Photosensitive member J) Surface layer |
|---|---|---|---|---|---|---|
| $SiH_4$[ml/min(normal)] | 200 | 200 | 15 | 15 | 15 | 15 |
| $H_2$[ml/min(normal)] | 600 | 750 | 100 | 100 | 100 | 100 |

TABLE 5-continued

| Type of gas/Condition | Example 3 | | | | | Comparative example 3 |
|---|---|---|---|---|---|---|
| | | | Surface layer | | | |
| | Lower electric-charge injection preventing layer | Photoconductive layer | Pre-peak area | Peak area | Post-peak area | (Photosensitive member J) Surface layer |
| $N_2$[ml/min(normal)] | — | — | 300 | 300 | 300 | 300 |
| $B_2H_6$[(ppm(versus $SiH_4$)] | 3000 | 0.2 | — | — | — | — |
| NO[% or ppm(versus $SiH_4$)] | 8% | — | 1 ppm | X ppm | 1 ppm | 1 ppm |
| $SiF_4$[(ppm(versus $SiH_4$)] | — | — | 1 ppm | Y ppm | 1 ppm | 1 ppm |
| Substrate temperature [° C.] | 260 | 260 | 240 | 240 | 240 | 240 |
| Pressure [Pa] | 65 | 80 | 60 | 60 | 60 | 60 |
| RF power [w] | 100 | 400 | 200 | 200 | 200 | 200 |
| Film thickness [μm] | 3 | 30 | 0.3 | 0.07 | 0.4 | 0.8 |

The prepared positively chargeable electrophotographic photosensitive members were mounted on the iR-6000 remodeled machine to evaluate evaluation items to be described later. Table 6 shows the evaluation result.

(1) Resolution (Dot Reproducibility)

By using blue (405 nm) semiconductor laser as an exposure light source similarly to the case of the Example 1 and printing out a 1-dot 1-space image, resolution was evaluated in accordance with reproducibility of dots of the image. The value of dot strain/laser-spot diameter was measured when setting a sport diameter to 30 μm and 1,200 dpi.

Obtained results were ranked through relative evaluation by using an image when using a spot diameter to 60 μm as a reference (REF) by using a red semiconductor laser (660 nm) for the photosensitive member J.

AA: Less than 85%, Very superior

A: 85% or more and less than 95%, Superior

B: 95% or more and less than 105%, Equal to the level of prior art (2) Charging Ability The prepared electrophotographic photosensitive member was set to the iR-6000 remodeled machine and electrified to measure the dark-area surface potential of the electrophotographic photosensitive member by a surface potentiometer (Model 344 made by TREK Inc.) set the position of a development counter. In this case, the charging conditions (DC voltage applied to electrifying unit, superimposed AC amplitude and frequency) were kept constant.

Obtained results were ranked through relative evaluation by using the dark-area surface potential of the photosensitive member J as a reference.

AA: 115% or more, Very superior

A: 105% or more and less than 115%, Superior

B: 95% or more and less than 105%, Equal to the level of prior art (3) Sensitivity The electrifying unit was adjusted so that the surface potential of the development counter becomes +450 V (dark potential) for the prepared electrophotographic photosensitive member and then, the light quantity of the image exposure light source was adjusted by applying image exposure (semiconductor laser beam having a wavelength of 405 nm) so that the surface potential of the photosensitive member becomes +50 V (bright potential) and the then exposure value was used as a sensitivity.

Obtained results were ranked through relative evaluation by using the exposure value of the photosensitive member J as a reference.

AA: Less than 85%, Very superior

A: 85% or more and less than 95%, Superior

B: 95% or more and less than 105%, Equal to the level of prior art (4) Optical Memory In the case of an optical memory potential, the difference between a surface potential when charging was realized in a state in which image exposure was not performed by the same potential sensor under a "sensitivity" evaluation condition and a surface potential when re-charging was realized after once performing image exposure was measured.

Obtained results were ranked through relative evaluation by using the potential difference of the photosensitive member J as a reference.

AA . . . Less than 85%, Very superior

A . . . 85% or more and less than 95%, Superior

B . . . 95% or more and less than 105%, Equal to the level of prior art

TABLE 6

| | NO X ppm | $SiF_4$ Y ppm | Omax/Omin | Fmax/Fmin | Dot reproducibility | Electrification ability | Sensitivity | Optical memory |
|---|---|---|---|---|---|---|---|---|
| 3-a | 5 | 1 | 1.8 | — | A | A | A | A |
| 3-b | 7 | 1 | 2 | — | AA | AA | AA | AA |
| 3-c | 20 | 1 | 8.5 | — | AA | AA | AA | AA |
| 3-d | 100 | 1 | 34 | — | AA | AA | AA | AA |
| 3-e | 1000 | 1 | 300 | — | AA | AA | AA | AA |
| 3-f | 1 | 5 | — | 1.7 | A | A | A | A |
| 3-g | 1 | 10 | — | 2.5 | AA | AA | AA | AA |
| 3-h | 1 | 30 | — | 4.5 | AA | AA | AA | AA |
| 3-i | 1 | 50 | — | 6.5 | AA | AA | AA | AA |
| 3-j | 50 | 10 | 13 | 2 | AA | AA | AA | AA |
| 3-k | 300 | 20 | 105 | 3 | AA | AA | AA | AA |

TABLE 6-continued

| | NO X ppm | $SiF_4$ Y ppm | Omax/ Omin | Fmax/ Fmin | Dot reproducibility | Electrification ability | Sensitivity | Optical memory |
|---|---|---|---|---|---|---|---|---|
| 3-l | 1500 | 40 | 500 | 4.5 | AA | AA | AA | AA |
| 3-m | 3000 | 60 | 850 | 8 | AA | AA | AA | AA |
| Photosensitive member J | 1 | 1 | — | — | B | B | B | B |

According to Table 6, by performing composition control of content and/or contents of oxygen atoms and/or fluorine atoms in a surface layer so that the number of atoms has a peak in the thickness direction in the surface layer, it is possible to improve dot reproducibility for the comparative example 3 in which a peak is not formed. When comparing an oxygen atom with a fluorine atom, the oxygen atom has more remarkable dot-reproducibility effect. Moreover, in the case of Examples from 3-b to 3-e, from 3-g to 3-i and from 3-j to 3-m, in which for a peak in the surface layer, contents or content of oxygen atoms and/or fluorine atoms form or forms a peak in the thickness direction so as to satisfy the relation of 2≦Omax/Omin and 2≦Fmax/Fmin, it is possible to simultaneously achieve further improvement of dot reproducibility, charging ability and sensitivity and reduction of optical memories for the comparative example 3 in which no peak is formed.

Example 4

Then, a surface layer was formed in which half-value widths or width of peaks or peak of contents or content of oxygen atoms and/or fluorine atoms are different. Similarly to the Example 3 except that the time required for change of gas supply quantities in a surface layer was changed, positively chargeable electrophotographic photosensitive members 4-a to 4-w were prepared. Gas flow rates Xppm and Yppm (for $SiH_4$ flow rate) of NO gas and $SiF_4$ gas flown while the deposition film of the surface layer was formed were controlled to (1) X=15 ppm, Y=1 ppm, (2) X=1 ppm, Y=14 ppm and (3) X=18 ppm and Y=20 ppm, the increase time and decrease time of supplied gas quantity were changed to form a surface layer having half-value widths of oxygen atoms and fluorine atoms shown in FIG. 7. The thickness of the surface layer shown in FIG. 7 was 0.8 μm.

Table 7 shows results of evaluating the electrophotographic photosensitive members thus prepared similarly to the case of the Example 3. In this case, in the depth profile, the half-value widths of peaks are peak widths in which the difference between peak contents or peak content of oxygen atoms and/or fluorine atoms and the content on a base line is halved.

TABLE 7

| | NO X ppm | $SiF_4$ Y ppm | Omax/ Omin | Fmax/ Fmin | O half-value width (nm) | F half-value width (nm) | Dot reproducibility | Charging ability | Sensitivity | Optical memory |
|---|---|---|---|---|---|---|---|---|---|---|
| 4-a | 15 | 1 | 8.1 | — | 5 | — | AA | A | A | AA |
| 4-b | 15 | 1 | 8 | — | 10 | — | AA | AA | AA | AA |
| 4-c | 15 | 1 | 8.2 | — | 15 | — | AA | AA | AA | AA |
| 4-d | 15 | 1 | 8.2 | — | 56 | — | AA | AA | AA | AA |
| 4-e | 15 | 1 | 8.1 | — | 150 | — | AA | AA | AA | AA |
| 4-f | 15 | 1 | 8.2 | — | 180 | — | AA | AA | AA | AA |
| 4-g | 15 | 1 | 8.2 | — | 200 | — | AA | AA | AA | AA |
| 4-h | 15 | 1 | 8.1 | — | 210 | — | A | AA | AA | A |
| 4-i | 1 | 14 | — | 2.3 | — | 6 | AA | A | A | AA |
| 4-j | 1 | 14 | — | 2.4 | — | 10 | AA | AA | AA | AA |
| 4-k | 1 | 14 | — | 2.4 | — | 14 | AA | AA | AA | AA |
| 4-l | 1 | 14 | — | 2.3 | — | 50 | AA | AA | AA | AA |
| 4-m | 1 | 14 | — | 2.3 | — | 170 | AA | AA | AA | AA |
| 4-n | 1 | 14 | — | 2.3 | — | 200 | AA | AA | AA | AA |
| 4-o | 1 | 14 | — | 2.4 | — | 220 | A | AA | AA | A |
| 4-p | 18 | 20 | 8.3 | 2.7 | 6 | 8 | AA | A | A | AA |
| 4-q | 18 | 20 | 8.3 | 2.7 | 10 | 12 | AA | AA | AA | AA |
| 4-r | 18 | 20 | 8.4 | 2.8 | 15 | 18 | AA | AA | AA | AA |
| 4-s | 18 | 20 | 8.4 | 2.8 | 50 | 56 | AA | AA | AA | AA |
| 4-t | 18 | 20 | 8.4 | 2.8 | 150 | 180 | AA | AA | AA | AA |
| 4-u | 18 | 20 | 8.3 | 2.8 | 180 | 200 | AA | AA | AA | AA |
| 4-v | 18 | 20 | 8.2 | 2.7 | 210 | 230 | A | AA | AA | A |
| 4-w | 18 | 20 | 8.3 | 2.7 | 215 | 241 | A | AA | AA | A |

According to Table 7, it is possible to improve dot reproducibility and charging ability in Examples from 4-b to 4-g, from 4-j to 4-n and from 4-q to 4-u formed so that the half-value widths or width of peaks or peak in the thickness directions or direction of oxygen atoms and/or fluorine atoms range or ranges 10 nm or more and 200 nm or less (ranges between 1.25 and to 25% for the whole thickness of the surface layer), it is possible to improve sensitivity and reduce optical memories at the same time.

Example 5

Then, a surface layer was formed in which composition distributions or distribution of contents or content of oxygen atoms and/or fluorine atoms were different.

By using the electrophotographic photosensitive member fabrication apparatus according to the RF-PCVD method shown in FIG. 3, positively chargeable electrophotographic photosensitive members 5-a to 5-f respectively constituted of a lower electric-charge injection preventing layer, photoconductive layer and surface layer whose schematic configuration is shown in FIG. 1A were prepared on a mirror-finished cylindrical aluminum substrate (conductive substrate) having a diameter of 80 mm by using the electrophotographic photosensitive member fabrication apparatus according to the RF-PCVD method shown in FIG. 3 under the fabrication conditions shown in Table 5 except that the gas supply quantity while a surface layer was formed and increase/decrease time of the supply quantity was changed in accordance with the conditions shown in Table 8. In the case of this Example, however, flow rates of NO gas and $SiF_4$ gas Xppm and Yppm (for $SiH_4$ flow rate) flown while the deposition film of the surface layer formed were controlled to (1) X=60 ppm, Y=2 ppm, (2) X=2 ppm, Y=25 ppm and (3) X=25 ppm, Y=35 ppm. In a peak forming area, each gas flow rate was adjusted and controlled so that peak shapes or peak shape of oxygen atoms and/or fluorine atoms have or has two types in which one type has a constant area and the other type does not have the constant area are realized. Specifically, for the type having the constant area portion, gas introduction was kept constant for certain time, for other portions, gas introduction was linearly changed so that a trapezoid is formed as a time change pattern of gas flow rate. The type having no constant area was controlled so that the time change pattern of gas flow rate becomes a triangle similarly to the case of the Example 2-4. While the surface layer was formed, the supply quantity of NO gas was linearly increased from 2 to Xppm (X=60) for $SiH_4$ gas and then, linearly decreased up to 2 ppm at the same speed. In this case, two types were realized in which one type (shown as continuous in Table 8) continuously performs supply of Xppm for predetermined time after supply of NO gas reaches Xppm and the other type (shown as peak in Table 8) immediately decrease the supply of Xppm. Moreover, supply quantity of $SiF_4$ gas was linearly increased from 2 up to Yppm (Y=25) for $SiH_4$ gas and then, linearly decreased up to 2 ppm at the same speed. In this case, supply of $SiF_4$ gas reached Yppm and then two types were realized in which one type continuously supplies Yppm for predetermined time (shown as continuous in Table 8) and the other type immediately decreases supply of Yppm (shown as peak in Table 8). Furthermore, the supply quantity of NO gas was increased from 2 up to Xppm (X=25) for $SiH_4$ gas and at the same time, the supply quantity of $SiF_4$ gas was linearly increased from 2 up to Yppm (Y=35) for $SiH_4$ gas and then, linearly decreased up to 2 ppm again at the same speed. In this case, two types were realized in which one type continuously performs supply of Xppm of NO gas and supply of Yppm of $SiF_4$ gas (shown as continuous in Table 8) and the other type immediately decreases the supply of Yppm of $SiF_4$ gas (shown as peak in Table 8). The composition distribution of oxygen atoms and/or fluorine atoms in the film became trapezoidal when the gas supply quantity was maximized and then continued and the composition distribution of atoms became a trapezoidal shape and when gas supply quantity reached maximum quantity and then was immediately decreased and supplied, the composition distribution of atoms became a trapezoidal shape and when gas supply quantity reached maximum quantity and then was immediately decreased and supplied, the composition distribution of atoms became peak-like. The peak half-value width in the peak forming area was set to 200 nm. The value of Omin was $3.0\times10^{18}$ atoms/cm$^3$ and the value of Fmin was $2.0\times10^{18}$ atoms/cm$^3$.

The positively chargeable electrophotographic photosensitive member thus prepared was evaluated similarly to the case of the Example 2. Table 8 shows the results.

TABLE 8

| | NO X ppm | $SiF_4$ Y ppm | Omax/ Omin | Fmax/ Fmin | O maximum value, Peak-like | F-value maximum, Peak-like | Dot reproducibility | Charging ability | Sensitivity | Optical memory |
|---|---|---|---|---|---|---|---|---|---|---|
| 5-a | 60 | 2 | 12.1 | — | Peak | — | AA | AA | AA | AA |
| 5-b | 60 | 2 | 12.1 | — | Continued | — | A | A | A | A |
| 5-c | 2 | 25 | — | 3 | — | Peak | AA | AA | AA | AA |
| 5-d | 2 | 25 | — | 3.1 | — | Continued | A | A | A | A |
| 5-e | 25 | 35 | 8.7 | 3.7 | Peak | Peak | AA | AA | AA | AA |
| 5-f | 25 | 35 | 8.7 | 3.7 | Continued | Continued | A | A | A | A |

According to Table 8, after supply of oxygen atoms and/or fluorine atoms reaches the maximum supply quantity in the surface layer and then is immediately decreased, dot reproducibility and charging ability are improved, sensitivity is remarkably increased and optical memories are decreased at the same time.

Example 6

A negatively chargeable electrophotographic photosensitive member of a color electrophotographic apparatus was prepared.

By using the electrophotographic photosensitive member fabrication apparatus in accordance with the RF-PCVD method shown in FIG. 3, the lower electric-charge injection preventing layer, photoconductive layer, upper electric-charge injection preventing layer constituted of an area containing 13th-group elements in the periodic table and negatively chargeable electrophotographic photosensitive members 6-a to 6-c respectively constituted of a surface layer whose schematic configuration is shown in FIG. 1C were prepared with the fabrication conditions shown in Table 9 on a mirror-finished cylindrical aluminum substrate having a diameter of 80 nm (conductive substrate). NO gas was linearly increased from 1 up to Xppm for $SiH_4$ gas and $SiF_4$ gas was linearly increased from 1 up to Yppm for $SiH_4$ gas while a deposition film of a surface layer was formed so that contents or content of oxygen atoms and/or fluorine atoms have or has peaks or a peak in the thickness direction of the surface layer and then NO gas and $SiF_4$ gas were linearly decreased up to 1 ppm at the same speed. The peak half-value width in a peak forming area was set to 100 nm. The value of Omin was $2.0\times10^{18}$ atoms/cm$^3$ and the value of Fmin was $1.0\times10^{18}$ atoms/cm$^3$.

Table 10 shows Omax/Omin and Fmax/Fmin about contents of oxygen atoms and fluorine atoms in the surface layer in accordance with the result of measuring a depth profile by SIMS (IMS-4F made by CAMECA Inc.) on the surface layer of each prepared electrophotographic photosensitive member.

Comparative Example 4

The negatively chargeable electrophotographic photosensitive member K (comparative example 4) was prepared similarly to the case of the Example 6 except that a-SiN:H is deposited by keeping film forming conditions constant by using types of gases shown in Table 9 as a surface layer.

Contents of oxygen atoms and fluorine atoms of the obtained photosensitive members were measured in the thickness direction in the surface layer by SIMS similarly to the case of the Example 6 and it was confirmed that there is no peak.

TABLE 9

| | Example 6 | | | | | | |
|---|---|---|---|---|---|---|---|
| | | | | Surface layer | | | Comparative |
| Type of gas/Condition | Lower electric-charge injection preventing layer | Photoconductive layer | Upper electric-charge injection preventing layer | Pre-peak area | Peak area | Post-peak area | example 4 Surface layer |
| $SiH_4$[ml/min(normal)] | 200 | 200 | 70 | 15 | 15 | 15 | 15 |
| $H_2$[ml/min(normal)] | 600 | 750 | — | 100 | 100 | 100 | 100 |
| $N_2$[ml/min(normal)] | — | — | 300 | 300 | 300 | 300 | 300 |
| $B_2H_6$[(ppm(versus $SiH_4$)] | 3000 | 0.2 | 6000 | — | — | — | — |
| NO[% or ppm(versus $SiH_4$)] | 8% | — | — | 1 ppm | X ppm | 1 ppm | 1 ppm |
| $SiF_4$[(ppm(versus $SiH_4$)] | — | — | — | 1 ppm | Y ppm | 1 ppm | 1 ppm |
| Substrate temperature [° C.] | 260 | 260 | 240 | 240 | 240 | 240 | 240 |
| Pressure [Pa] | 65 | 80 | 60 | 60 | 60 | 60 | 60 |
| RF power [w] | 100 | 400 | 200 | 200 | 200 | 200 | 200 |
| Film thickness [μm] | 3 | 30 | 0.05 | 0.3 | 0.1 | 0.4 | 0.8 |

The prepared negatively chargeable electrophotographic photosensitive members were mounted on the iR-6000 remodeled machine and the following evaluation items were evaluated. Table 10 shows the evaluation results.

(1) Resolution (Dot Reproducibility)

A blue (405 nm) semiconductor laser was used as an exposure light source similarly to the case of the Example 1, a 1-dot 1-space image was printed out and resolution was evaluated in accordance with the dot reproducibility of the image. The value of dot strain/laser spot diameter was measured when setting the spot diameter to 30 μm and 1,200 dpi. Obtained results were ranked through relative evaluation on the reference (REF) of an image when using a red semiconductor laser (660 nm) for the photosensitive member K and setting the spot diameter to 60 μm.

AA: Less than 85%, Very superior

A: 85% or more and less than 95%, Superior

B: 95% or more and less than 105%, Equal to the level of prior art (2) Charging Ability The prepared electrophotographic photosensitive member was set to the iR-6000 remodeled machine and electrified to measure the dark-area surface potential of the electrophotographic photosensitive member by a surface potentiometer set to the position of a development counter. In this case, charging conditions (DC voltage applied to electrifying unit, superimposed AC amplitude and frequency) were kept constant. Obtained results were ranked through relative evaluation on the basis of the dark-area surface potential of the photosensitive member K.

AA: 115% or more, Very superior

A: 105% or more and less than 115%, Superior

B: 95% or more and less than 105%, Equal to the level of prior art (3) Sensitivity After adjusting an electrifying unit so that the surface potential of the prepared electrophotographic photosensitive member at the position of a development counter becomes −450 V (dark potential), image exposure (semiconductor laser beam having a wavelength of 405 nm) was applied to adjust the light quantity of an image exposure light source so that the surface potential of the photosensitive member becomes −50 V (bright potential) and then the exposure value was used as sensitivity.

Obtained results were ranked through relative evaluation on the basis of the exposure value of the photosensitive member K.

AA: Less than 85%, Very superior

A: 85% or more and less than 95%, Superior

B: 95% or more and less than 105%, Equal to the level of prior art (4) Optical Memory In the case of an optical memory, the difference between the surface potential of a photosensitive member when electrified in a state in which image exposure is not performed by the same potential sensor under "sensitivity" evaluation conditions and the surface potential when electrified again after once image exposure is performed was measured.

Obtained results were ranked through relative evaluation on the basis of the potential difference of the photosensitive member K.

AA: Less than 85%, Very superior

A: 85% or more and less than 95%, Superior

B: 95% or more and less than 105%, Equal to the level of prior art

TABLE 10

| | NO X ppm | $SiF_4$ Y ppm | Omax/ Omin | Fmax/ Fmin | Dot reproducibility | Charging ability | Sensitivity | Optical memory |
|---|---|---|---|---|---|---|---|---|
| 6-a | 65 | 0 | 14 | — | AA | AA | AA | AA |
| 6-b | 0 | 30 | — | 3.5 | AA | AA | AA | AA |
| 6-c | 65 | 30 | 14 | 3.6 | AA | AA | AA | AA |
| Photosensitive member K | 1 | 1 | — | — | B | B | B | B |

According to Table 10, in the case of the negatively chargeable electrophotographic photosensitive member having an upper electric-charge injection preventing layer containing 13th-group elements of the periodic table, by performing composition control of contents or content of oxygen atoms and/or fluorine atoms in a surface layer so that the number of atoms for unit length in the thickness direction has a maximum-value peak, it is found that it is possible to achieve improvement of dot reproducibility and charging ability, increase of sensitivity and reduction of optical memories at the same time to the comparative example that does not form any peak.

Example 7

Similarly to the case of the Example 6, deposition films were sequentially laminated in accordance with the conditions shown in Table 11, a negatively chargeable photosensitive member constituted of the lower electric-charge injection preventing layer, photoconductive layer, upper electric-charge injection preventing layer and surface layer shown in FIG. 1C was prepared. When forming the surface layer, a constant quantity of $O_2$ was supplied to $SiH_4$ gas by Z (ppm) and in a peak area containing the maximum quantity, NO gas was supplied to prepare photosensitive members 7-a to 7-g having oxygen-atom concentrations different from each other. Similarly, $SiF_4$ gas was used to form a peak area of a fluorine-atom content.

Actual nitrogen atom concentration and oxygen atom concentration of the photosensitive members in the surface layer thus prepared were analyzed by SIMS after removing the surface by approx. 20 nm and removing the influence of the outermost surface. The nitrogen concentration was approx. 53 atm % by the expression of in-film average of N/Si+N. Moreover, Table 12 shows the value of oxygen concentration in a photosensitive member prepared by a different oxygen-gas addition value Z (ppm) by the expression of the in-film average of O/Si+N+O. Moreover, though Omax/Omin showing the height of a peak was slightly changed by an oxygen concentration in a film other than the peak, it was 14 for every film. Moreover, Fmax/Fmin was 3.5.

TABLE 11

| | Example 7 | | | | | |
|---|---|---|---|---|---|---|
| | | | | Surface layer | | |
| Type of gas/Condition | Lower electric-charge injection preventing layer | Photoconductive layer | Upper electric-charge injection preventing layer | Pre-peak area | Peak area | Post-peak area |
| $SiH_4$[ml/min(normal)] | 200 | 200 | 70 | 15 | 15 | 15 |
| $H_2$[ml/min(normal)] | 600 | 750 | — | 100 | 100 | 100 |
| $N_2$[ml/min(normal)] | — | — | 300 | 300 | 300 | 300 |
| $B_2H_6$[(ppm(versus $SiH_4$)] | 3000 | 0.2 | 6000 | — | — | — |
| NO[% or ppm(versus $SiH_4$)] | 8% | — | — | 1 ppm | 65 ppm | 1 ppm |
| $SiF_4$[(ppm(versus $SiH_4$)] | — | — | — | 1 ppm | 30 ppm | 1 ppm |
| $O_2$[(ppm(versus $SiH_4$)] | — | — | — | Z ppm | Z ppm | Z ppm |
| Substrate temperature [° C.] | 260 | 260 | 240 | 240 | 240 | 240 |
| Pressure [Pa] | 65 | 80 | 60 | 60 | 60 | 60 |
| RF power [w] | 100 | 400 | 200 | 200 | 200 | 200 |
| Film thickness [μm] | 3 | 30 | 0.05 | 0.3 | 0.1 | 0.4 |

These photosensitive members were mounted on the iR-6000 remodeled machine to perform the following evaluation. First, to measure the resolution of a photosensitive member, dot reproducibility was evaluated in accordance with the evaluation method same as the case of the Example 6. The following evaluation was performed on the basis of Z=0 ppm, that is, a photosensitive member to which oxygen was not added.

AA: Less than 85%, Very superior

A: 85% or more and less than 95%, Superior

B: 95% or more and less than 105%, Equal to the level of prior art

Then, to evaluate the environment-resistant characteristic of a photosensitive member, the above iR-6000 remodeled machine was set in a high-temperature high-humidity environmental laboratory having room temperature of 30° C. and humidity of 80% to evaluate an image characteristic at a predetermined interval while performing sheet-feed durability tests of 500,000 A4-copy sheets.

The image characteristic was evaluated by using the following two types of images.

(1) Image in which a pixel density is stepwise changed from 0% to 100%

(2) Image in which characters of 5-point size are arranged

Specifically, presence or absence of a micro image blurring at a dot level was evaluated in accordance with half-tone graduation property, that is, linearity of pixel density and image density by using (1) and presence or absence of an image blurring which can be confirmed at a character level was evaluated by using (2). Moreover, the image characteristic evaluation in the above-described high-temperature high-humidity environment was performed by adjusting the exposure optical system to 600 dpi, 1,200 dpi and 2,400 dpi respectively. Results obtained through the above measurements were evaluated for each photosensitive member in accordance with the references shown below.

AA: No image blurring does not occur over a durable period. Very good

A: Though there is a case in which half-tone gradation property is deteriorated immediately after a machine is started in the morning when durability is progressed, the half-tone gradation property is completely recovered through feed of several sheets. Good B: Though there is a case in which an image blurring which can be confirmed at a character level is occurred immediately after a machine is started in the morning when durability is progressed, the image blurring is completely recovered through feed of several sheets. There is no problem for practical use.

TABLE 12

| | $O_2$ | O concentration | Dot reproducibility | Image blurring under high-temperature high-humidity environment | | |
|---|---|---|---|---|---|---|
| | Z ppm | Atm % | | 600 dpi | 1200 dpi | 2400 dpi |
| 7-a | 0 | 0.002 | REF | AA | AA | AA |
| 7-b | 5 | 0.01 | A | AA | AA | AA |
| 7-c | 250 | 0.51 | AA | AA | AA | AA |
| 7-d | 1500 | 4.1 | AA | AA | AA | AA |
| 7-e | 3500 | 9.7 | AA | AA | AA | AA |
| 7-f | 9000 | 19 | AA | AA | AA | A |
| 7-g | 14000 | 25 | AA | AA | A | A |

As shown in Table 12, by further adding oxygen atoms to the whole surface layer, it is found that resolution is improved compared to the case in which oxygen atoms are not added. By setting the in-film average concentration of oxygen atoms to 0.01 atm % or more, resolution is improved by 10% or more compared to the case of the Example 7-a in which oxygen atoms are not added to the whole surface layer and moreover, by setting the oxygen atom concentration to 0.5 atm % or more, it is found that resolution is improved by 20% or more compared to the case of the comparative example 3 and Example 7-a.

However, in the case of 600 dpi, no image blurring occurs under the high-temperature high-humidity environment in every photosensitive member independently of an oxygen concentration. However, in the case of 1,200 or 2,400 dpi, when the oxygen concentration in the surface layer rises, lowering of the evaluation rank of the image blurring is recognized under the high-temperature high-humidity environment in the case of a photosensitive member aiming at higher image quality. From this result, it is found that a preferable range of oxygen concentration has an upper limit and the upper limit is preferably 20 atm % or less, more preferably 10 atm % or less.

Example 8

Deposition films were sequentially laminated under the conditions shown in Table 11 similarly to the case of the Example 7 to prepare photosensitive members respectively constituted of a lower electric-charge injection preventing layer, photoconductive layer, upper electric-charge injection preventing layer and surface layer. In the case of formation of the surface layer, the following three types of photosensitive members were prepared: a photosensitive member to which no $O_2$ is added (Z=0 ppm), a photosensitive member to which a certain quantity of $O_2$ is added (Z=1,500 ppm) and a photosensitive member in which $O_2$ addition quantity is linearly changed (Z is changed from 0 to 3,000 ppm and the average value in a film is set to 1,500 ppm). Thus, three types of photosensitive members 8-a to 8-c having oxygen atom concentrations different from each other in the surface layer were prepared.

Actual nitrogen atom concentrations and oxygen atom concentrations of the photosensitive members thus prepared in the surface layer were analyzed by SIMS after removing the surface by approx. 20 nm and a portion influenced by the environment of the outermost surface. The nitrogen concentration was approx. 53 atm % in the expression of in-film average of N/Si+N of the surface layer. Moreover, Table 13 shows values of oxygen concentrations of the photosensitive members in the surface layer in the expression of in-film average of O/Si+N+O. Both of Omax/Omin and Fmax/Fmin respectively showing a peak height were 2 or more.

These photosensitive members are mounted on the iR-6000 remodeled machine to perform the following evaluation.

These photosensitive members were mounted on the iR-6000 remodeled machine and the following evaluation was performed.

First, to measure resolutions of the photosensitive members, dot reproducibility was evaluated in accordance with the same evaluation method as the case of the Example 6. Evaluation was performed as shown below on the basis of a photosensitive member to which oxygen was not added to an area other than a peak (Z=0 ppm) (Example 8-a).

AA: 75% or more and less than 85%, Very superior

A: 85% or more and less than 95%, Superior

B: 95% or more and less than 105%

An optical memory was evaluated in accordance with the same method as the case of the Example 6. Evaluation was performed as shown below by using the Example 8-a as a reference.

AA: Less than 85%, Very superior

A: 85% or more and less than 95%, Superior

B: 95% or more and less than 105%

TABLE 13

| | $O_2$ Z ppm | O concentration other than peak Y atm % | Dot reproducibility | Optical memory |
|---|---|---|---|---|
| 8-a | 0 | 0.002 | B | B |
| 8-b | 1500 | 4.1 | AA | A |
| 8-c | 0 → 3000 | 4.2 | AA | AA |

As shown in Table 13, by further adding oxygen atoms to the whole surface layer, resolution and memory characteristic are first improved. Moreover, it is found that optical memories are further improved by distributing concentrations so as to increase toward the surface side though average concentrations of oxygen atoms in the film are equal.

This application claims priority from Japanese Patent Application No. 2004-322773 filed Nov. 5, 2004, which is hereby incorporated by reference herein.

What is claimed is:

1. An electrophotographic photosensitive member comprising a substrate, a photoconductive layer formed on the substrate and a surface layer formed on the photoconductive layer using silicon and nitrogen atoms as the base material and constituted of non-single-crystal material at least containing oxygen atoms, characterized in that the surface layer contains nitrogen atoms as an average concentration shown by the following expression (1) and contains oxygen atoms by the maximum value Omax of the number of oxygen atoms in the thickness direction:

$$0.3 \leqq N/(Si+N) \leqq 0.7 \quad (1)$$

wherein N denotes the number of nitrogen atoms and Si denotes the number of silicon atoms; and the surface layer contains oxygen atoms by the minimum value Omin of the number of oxygen atoms in the thickness direction and the minimum value Omin satisfies the relation shown by the following expression (2):

$$2 \leqq Omax/Omin \quad (2).$$

2. The electrophotographic photosensitive member according to claim 1, characterized in that the surface layer has a half-value width of 10 nm or more and 200 nm or less in a graph in which thickness is assigned to the axis of abscissa and the content of oxygen atoms is assigned to the axis of ordinate.

3. The electrophotographic photosensitive member according to claim 1 characterized in that the surface layer has the minimum value Omin of the number of oxygen atoms at a contact portion with a lower layer.

4. The electrophotographic photosensitive member according to claim 1, characterized in that a non-single-crystal material using silicon atoms and nitrogen atoms constituting the surface layer as base material and containing at least oxygen atoms contains oxygen atoms as an average concentration shown by the following expression (3):

$$0.0001 \leqq O/(Si+N+O) \leqq 0.2 \quad (3)$$

wherein N denotes the number of nitrogen atoms, Si denotes the number of silicon atoms and O denotes the number of oxygen atoms.

5. The electrophotographic photosensitive member according to claim 1, characterized in that the photoconductive layer is constituted of a non-single-crystal material using silicon atoms as base material.

6. The electrophotographic photosensitive member according to claim 1, characterized in that a potential attenuation value for unit energy quantity of a laser beam having a wavelength of 405 nm is 300 $V \cdot cm^2/\mu J$ or more.

7. An electrophotographic apparatus characterized by mounting the electrophotographic photosensitive member according to claim 1.

8. An electrophotographic photosensitive member comprising:

a substrate;

a photoconductive layer formed on the substrate; and a surface layer constituted of a non-single-crystal material formed on the photoconductive layer using silicon and nitrogen atoms as the base material and containing at least fluorine; characterized in that the surface layer contains nitrogen atoms as an average concentration shown by the following expression (4) and fluorine atoms by the maximum value Fmax of the number of fluorine atoms in the thickness direction:

$$0.3 \leqq N/(Si+N) \leqq 0.7 \quad (4)$$

wherein N denotes the number of nitrogen atoms and Si denotes the number of silicon atoms; and the surface layer contains fluorine atoms by the minimum value Fmin of the number of fluorine atoms in the thickness direction and has the relation shown by the following expression (5):

$$2 \leqq Fmax/Fmin \quad (5).$$

9. The electrophotographic photosensitive member according to claim 8, characterized in that the surface layer has a half-value width of 10 nm or more and 200 nm or less in a graph in which thickness is assigned to the axis of abscissa and content of fluorine atoms is assigned to the axis of ordinate.

10. The electrophotographic photosensitive member according to claim 8, characterized in that the surface layer has the minimum value Fmin of the number of fluorine atoms at a contact portion with a lower layer.

11. The electrophotographic photosensitive member according to claim 8, characterized in that a non-single-crystal material using silicon and nitrogen atoms constituting the surface layer as base material and containing at least fluorine atoms further contains oxygen atoms and oxygen atoms as an average concentration shown by the following expression (6):

$$0.0001 \leqq O/(Si+N+O) \leqq 0.2 \quad (6)$$

wherein N denotes the number of nitrogen atoms, Si denotes the number of silicon atoms and O denotes the number of oxygen atoms.

12. The electrophotographic photosensitive member according to claim 8, characterized in that the photoconductive layer is constituted of a non-single-crystal material using silicon atoms as base material.

13. The electrophotographic photosensitive member according to claim 8, characterized in that a potential attenuation value for unit energy quantity of a laser beam having a wavelength of 405 nm is 300 $V \cdot cm^2/\mu J$ or more.

14. An electrophotographic photosensitive member comprising:

a substrate;

a photoconductive layer formed on the substrate; and a surface layer formed on the photoconductive layer and constituted of a non-single-crystal material using silicon and nitrogen atoms as base material and containing at least oxygen atoms and fluorine atoms, characterized in that the surface layer contains nitrogen atoms as an average concentration shown by the following expression (7), contains oxygen atoms by the maximum value Omax of the number of oxygen atoms in the thickness direction and contains fluorine atoms by the maximum value Fmax of the number of fluorine atoms:

$$0.3 \leqq N/(Si+N) \leqq 0.7 \quad (7)$$

wherein N denotes the number of nitrogen atoms and Si denotes the number of silicon atoms; and the surface layer contains oxygen atoms by the minimum value Omin of the number of oxygen atoms in the thickness direction and contains fluorine atoms by the minimum value Fmin of the number of fluorine atoms and minimum values Omin and Fmin respectively satisfy the relations shown by the following expressions (8) and (9):

$$2 \leqq Omax/Omin \quad (8)$$

$$2 \leqq Fmax/Fmin \quad (9).$$

15. The electrophotographic photosensitive member according to claim 14, characterized in that the surface layer has a half-value width of 10 nm or more and 200 nm or less in a graph in which thickness is assigned to the axis of abscissa and content of oxygen and fluorine atoms is assigned to the axis of ordinate.

16. The electrophotographic photosensitive member according to claim 14, characterized in that the surface layer has the minimum value Omin of the number of oxygen atoms and the minimum value Fmin of the number of fluorine atoms at a contact portion with a lower layer.

17. The electrophotographic photosensitive member according to claim 14, characterized in that the photoconductive layer is constituted of a non-single-crystal material using silicon atoms as base material.

18. The electrophotographic photosensitive member according to claim 14, characterized in that a potential attenuation value for unit energy quantity of a laser beam having a wavelength of 405 is 300 $V \cdot cm^2/\mu J$ or more.

* * * * *

UNITED STATES PATENT AND TRADEMARK OFFICE

CERTIFICATE OF CORRECTION

PATENT NO. : 7,229,731 B2
APPLICATION NO. : 11/406416
DATED : June 12, 2007
INVENTOR(S) : Makoto Aoki et al.

It is certified that error appears in the above-identified patent and that said Letters Patent is hereby corrected as shown below:

ON THE TITLE PAGE [56] REFERENCES CITED:

Foreign Patent Documents,
"JP 0-8076397 3/1996" should read --JP 8-076397 3/1996--;
"JP 2000/01975 1/2000" should read --JP 2000-01975 1/2000--; and
"JP 2000/311693 10/2002" should read --JP 2002-311693 10/2002--.

ON THE TITLE PAGE [57] ABSTRACT:

Line 5, "characteristic and" should read --characteristic,--;
Line 6, "safety and" should read --safety,--, "in" should be deleted, and "resistance and" should read --resistance,--;
Line 11, "substrate and" should read --substrate,--; and
Line 12, "and" should be deleted.

COLUMN 2:

Line 21, "photocon" should --photocon- --.

COLUMN 4:

Line 12, "a" should read --an--; and
Line 45, "scrapped" should read --scraped--.

Figure 7:
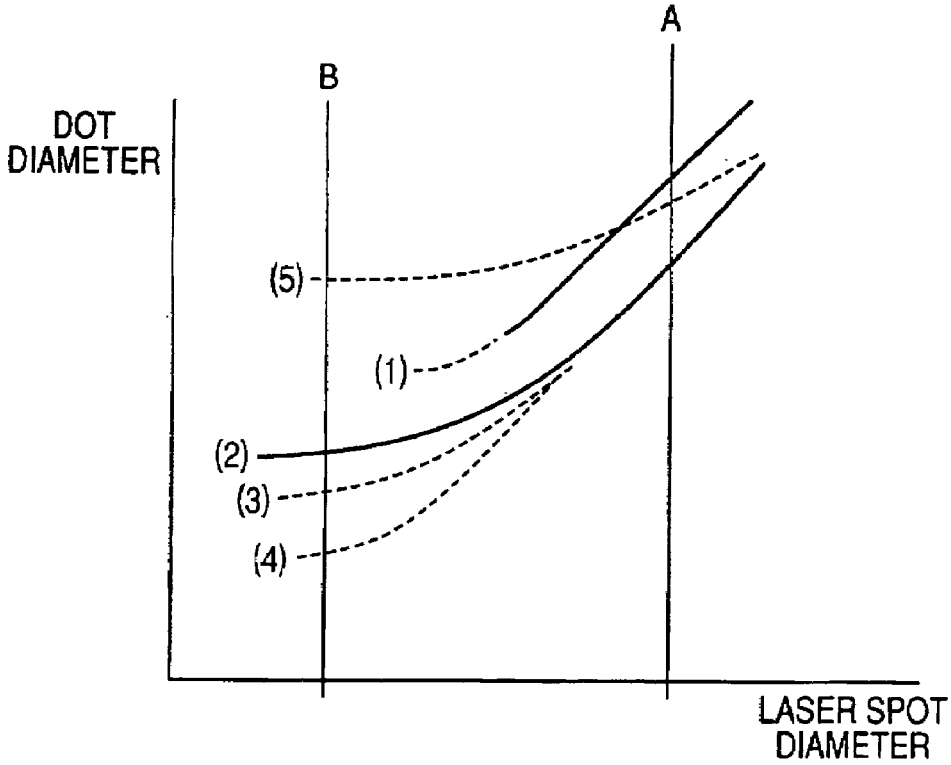
FIG. 7 is an illustration showing the relation between dot diameter of an image of an electrophotographic photosensitive member of the present invention and spot diameter of a laser beam.

COLUMN 6:

Line 37, "Fig. 7;" should read --Fig. 7,--.

COLUMN 7:

Line 5, "a" should be deleted.

UNITED STATES PATENT AND TRADEMARK OFFICE

CERTIFICATE OF CORRECTION

PATENT NO. : 7,229,731 B2
APPLICATION NO. : 11/406416
DATED : June 12, 2007
INVENTOR(S) : Makoto Aoki et al.

It is certified that error appears in the above-identified patent and that said Letters Patent is hereby corrected as shown below:

COLUMN 11:

Line 49, "Then," should read --Next,--.

COLUMN 12:

Line 42, "electrical" should read --electrically--.

COLUMN 15:

Line 53, "atoms.)." should read --atoms.)--; and
Line 67, "atoms.)." should read --atoms.)--.

COLUMN 16:

Line 26, "an" should read --a--;
Line 33, "charg" should read --charge--; and
Line 54, "atoms.)." should read --atoms.)--.

COLUMN 18:

Line 30, "atoms.)." should read --atoms.)--.

COLUMN 20:

Line 45, "and $1x10^{-2}$ Pa" should read --and $1x10^{2}$ Pa--.

COLUMN 21:

Line 7, "$P_W F_N/(F_{si})^2$" should read --"$P_w \bullet F_N/(F_{si})^2$" --; and
Line 27, "a" should be deleted.

UNITED STATES PATENT AND TRADEMARK OFFICE

CERTIFICATE OF CORRECTION

PATENT NO. : 7,229,731 B2
APPLICATION NO. : 11/406416
DATED : June 12, 2007
INVENTOR(S) : Makoto Aoki et al.

It is certified that error appears in the above-identified patent and that said Letters Patent is hereby corrected as shown below:

COLUMN 23:

Line 53, “over on” should be deleted.

COLUMN 26:

Line 31, “are closed” should be deleted;
Line 35, “vale” should read --valve--; and
Line 48, “sheath-like-heater” should read --sheath-like--heater,--.

COLUMN 28:

Line 1, “Then,” should read --Next,--.

COLUMN 29:

Line 18, “glipper” should read --gripper--.

COLUMN 30:

Line 65, “was $1.2x10^{13}$” should read --was $1.2x10^{18}$--.

COLUMN 31:

Line 11, “point” should read --points--; and
Line 60, “tend” should read --tendency--.

COLUMN 33:

Line 63, “an” should be deleted.

COLUMN 35:

Line 25, “sot” should read --spot--.

UNITED STATES PATENT AND TRADEMARK OFFICE

CERTIFICATE OF CORRECTION

PATENT NO. : 7,229,731 B2
APPLICATION NO. : 11/406416
DATED : June 12, 2007
INVENTOR(S) : Makoto Aoki et al.

It is certified that error appears in the above-identified patent and that said Letters Patent is hereby corrected as shown below:

COLUMN 36:

Line 45, “example 3) constituted” should read --example 3) is constituted--.

COLUMN 37:

Line 29, “sport” should read --spot--; and
Line 43, “set the” should read --set to the--.

COLUMN 41:

Line 15, “layer formed” should read --layer was formed--.

COLUMN 47:

Line 11, “No image” should read --Image--.

COLUMN 49:

Line 29, “claim 1” should read --claim 1,--.

COLUMN 50:

Line 24, “and oxygen atoms” should be deleted.

Signed and Sealed this

Fifteenth Day of April, 2008

JON W. DUDAS
*Director of the United States Patent and Trademark Office*